US009580931B2

(12) United States Patent
Myers et al.

(10) Patent No.: US 9,580,931 B2
(45) Date of Patent: Feb. 28, 2017

(54) MORTISE LOCK APPARATUS AND ELECTRONIC OPERATING SYSTEM

(75) Inventors: Gary L. Myers, Monee, IL (US); Ashok Hirpara, Carol Stream, IL (US); Michael Aaron Cohen, Buffalo Grove, IL (US); John D. Veleris, Northbrook, IL (US); Alyssa M. Nelson, Crown Point, IN (US)

(73) Assignee: Belwith Products, LLC, Grandville, MI (US)

( * ) Notice: Subject to any disclaimer, the term of this patent is extended or adjusted under 35 U.S.C. 154(b) by 313 days.

(21) Appl. No.: 14/110,370

(22) PCT Filed: Apr. 25, 2012

(86) PCT No.: PCT/US2012/035017

§ 371 (c)(1),
(2), (4) Date: Oct. 7, 2013

(87) PCT Pub. No.: WO2012/149033

PCT Pub. Date: Nov. 1, 2012

(65) Prior Publication Data

US 2014/0033773 A1 Feb. 6, 2014

Related U.S. Application Data

(60) Provisional application No. 61/518,240, filed on Apr. 25, 2011.

(51) Int. Cl.
*E05B 65/06* (2006.01)
*E05B 9/08* (2006.01)
(Continued)

(52) U.S. Cl.
CPC ..... *E05B 9/082* (2013.01); *E05B 9/02* (2013.01); *E05B 15/02* (2013.01);
(Continued)

(58) Field of Classification Search
CPC ..... E05B 3/00; E05B 3/06; E05B 9/00; E05B 9/002; E05B 9/02; E05B 9/08; E05B 9/082;
(Continued)

(56) References Cited

U.S. PATENT DOCUMENTS 4,296,619 A 10/1981 Widen
4,699,409 A 10/1987 Newman
(Continued)

FOREIGN PATENT DOCUMENTS

CN 2425976 Y 4/2001
CN 101586421 A 11/2009
(Continued)

OTHER PUBLICATIONS

European Patent Office, International Search Report in International Patent Application No. PCT/US2012/035017, 7 pp. (Dec. 4, 2013).
(Continued)

*Primary Examiner* — Christopher Boswell
(74) *Attorney, Agent, or Firm* — Leydig, Voit & Mayer, Ltd.

(57) ABSTRACT

The disclosure describes a locking system for a door with a mortise pocket. The locking system has a mortise case within the mortise pocket. The mortise case defines an alignment hole. The locking system also has a gear box with a worm gear that defines a notched passage that receives a lock knob shaft. A worm within the gear box is coupled to a motor that rotates the worm. The worm engages the worm gear such that the worm gear rotates when the worm rotates. A control board in the gear box is adapted to receive electronic signals and transmit them to the motor to cause the motor to rotate the worm. The gear box also has a worm gear hub that defines a keyed passage and a hub tab. The worm gear hub fits within the notched passage and the keyed
(Continued)

passage receives the lock knob shaft. The worm gear also has two notches that the hub tab contacts individually when the gear hub rotates within the notched passage.

11 Claims, 49 Drawing Sheets

(51) Int. Cl.

| | |
|---|---|
| ***E05B 15/02*** | (2006.01) |
| ***E05B 9/02*** | (2006.01) |
| ***E05B 17/00*** | (2006.01) |
| ***E05B 63/08*** | (2006.01) |
| ***E05C 1/00*** | (2006.01) |
| *E05B 47/00* | (2006.01) |

(52) U.S. Cl.
CPC ..... *E05B 17/0004* (2013.01); *E05B 47/0012* (2013.01); *E05B 63/08* (2013.01); *E05C 1/004* (2013.01); *E05B 2047/002* (2013.01); *E05B 2047/0091* (2013.01); *Y10T 29/49947* (2015.01); *Y10T 70/5319* (2015.04); *Y10T 292/1021* (2015.04); *Y10T 292/1022* (2015.04); *Y10T 292/62* (2015.04)

(58) Field of Classification Search
CPC .. E05B 15/02; E05B 2015/1657; E05B 47/00; E05B 47/001; E05B 47/0012; E05B 47/02; E05B 47/026; E05B 2047/0014; E05B 2047/0015; E05B 2047/0018; E05B 2047/002; E05B 2047/0091
USPC ..... 70/101, 102, 104, 124, 129, 275, 277, 70/278.1, 278.7, 279.1, 280, 281, 282
See application file for complete search history.

(56) References Cited

U.S. PATENT DOCUMENTS

| | | | | | |
|---|---|---|---|---|---|
| 4,833,465 | A * | 5/1989 | Abend | E05B 47/0012 | 292/144 |
| 5,083,448 | A * | 1/1992 | Karkkainen | E05B 47/0012 | 292/144 |
| 5,199,288 | A * | 4/1993 | Merilainen | E05B 47/0012 | 292/144 |
| 6,012,310 | A * | 1/2000 | Hsiao | E05B 47/0012 | 292/144 |
| 6,145,353 | A * | 11/2000 | Doucet | E05B 47/0692 | 70/149 |
| 6,418,763 | B1 * | 7/2002 | Huang | E05B 47/0012 | 292/144 |
| 6,418,765 | B1 * | 7/2002 | Chiu | E05B 47/0012 | 70/277 |
| 6,826,937 | B2 * | 12/2004 | Su | E05B 9/082 | 70/107 |
| 7,347,463 | B2 * | 3/2008 | Blight | E05B 9/082 | 292/337 |
| 7,770,423 | B2 * | 8/2010 | Wu | E05B 47/0012 | 292/142 |
| 7,818,984 | B2 * | 10/2010 | Hwang | E05B 13/005 | 292/21 |
| 8,490,445 | B2 * | 7/2013 | Chiou | E05B 47/0012 | 70/224 |
| 9,103,141 | B2 * | 8/2015 | Hesselback | E05B 9/08 | |
| 2002/0084656 | A1 | 7/2002 | Lin | | |
| 2005/0132766 | A1 * | 6/2005 | Milo | E05B 47/0012 | 70/279.1 |
| 2006/0283219 | A1 * | 12/2006 | Bendz | E05B 47/0012 | 70/431 |
| 2008/0067820 | A1 | 3/2008 | Huang et al. | | |
| 2009/0100883 | A1 | 4/2009 | Kondratuk | | |
| 2009/0173114 | A1 * | 7/2009 | Lin | E05B 47/0012 | 70/91 |
| 2009/0173120 | A1 | 7/2009 | Lin et al. | | |
| 2010/0140961 | A1 * | 6/2010 | Tien | E05B 3/00 | 292/93 |
| 2013/0139561 | A1 * | 6/2013 | Parto | E05B 47/0611 | 70/278.7 |
| 2014/0250956 | A1 * | 9/2014 | Chong | E05B 49/00 | 70/278.1 |
| 2015/0137536 | A1 * | 5/2015 | Kondratuk | E05B 15/02 | 292/336.3 |

FOREIGN PATENT DOCUMENTS

| | | | |
|---|---|---|---|
| CN | 201420434 | Y | 3/2010 |
| DE | 102006053585 | A1 | 6/2007 |
| WO | WO 03/080968 | A1 | 10/2003 |
| WO | WO 2008/101928 | A1 | 8/2008 |

OTHER PUBLICATIONS

European Patent Office, Written Opinion in International Patent Application No. PCT/US2012/035017, 10 pp. (Dec. 4, 2013).

* cited by examiner

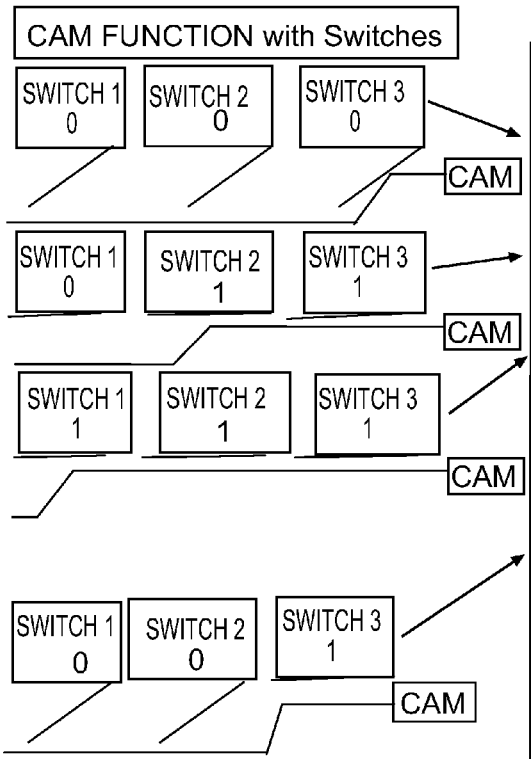

| SWITCH 1 | SWITCH 2 | SWITCH 3 | CONDITION |
|---|---|---|---|
| 0 | 0 | 0 | LOCKED |
| 0 | 1 | 1 | NEUTRAL |
| 1 | 1 | 1 | OPEN |
| 0 | 0 | 1 | ASSUME LOCK CONDITION RADIO OPEN ATTEMPT MOVE TO NEUTRAL SEND ERROR SIGNAL RADIO LOCK > IGNORE |
| 0 | 1 | 0 | SWITCH 3 BAD ASSUME NEUTRAL RADIO OPEN OR LOCK DO NOTHING SEND ERROR SIGNAL |
| 1 | 0 | 0 | SWITCH 2 & 3 BAD RADIO OPEN DO NOTHING SEND ERROR SIGNAL |
| 1 | 1 | 0 | SWITCH 3 BAD ASSUMED OPEN CONDITION RADIO OPEN OR LOCK MOVE TO NEUTRAL SEND ERROR MESSAGE |
| 1 | 0 | 1 | SWITCH 2 BAD RADIO OPEN OR LOCK PERFORM TIME FUNCTION IF POSSIBLE TO GET TO TIMED NEUTRAL |

*FIG. 42*

| | CAM Switch 1 | CAM Switch 2 | CAM Switch 3 | Latch Switch | Activation Switch | |
|---|---|---|---|---|---|---|
| LOCKED | 0 | 0 | 0 | | | |
| NEUTRAL | 0 | 1 | 1 | | | |
| OPEN | 1 | 1 | 1 | | | |
| | 0 | 0 | 1 | | | |
| | 0 | 1 | 0 | | | |
| | 1 | 0 | 0 | | | |
| | 1 | 1 | 0 | | | |
| | 1 | 0 | 1 | | | |

NORMAL OPERATIONS

ALL VARIATIONS POSSIBLE

FIG. 43

| CAM_SW_1 | CAM_SW_2 | CAM_SW_3 | MOTOR OPERATION | MOTOR STATE (CONDITION) | LAST OPERATION | INTERRUPT ON CAM SW | TRANSITION FOR INT | CAM SW1 CONFIG | CAM SW2 CONFIG | CAM SW3 CONFIG |
|---|---|---|---|---|---|---|---|---|---|---|
| SWITCH_1 | SWITCH_2 | SWITCH_3 | | | | | | | | |
| FOR UNLOCK (OPEN) SEQUENCE | | | | | UNLOCK (OPEN) | | | | | |
| 1 | 1 | 0 | START | NEUTRAL1 | | CAM SW_1 | HIGH TO LOW | IPD | IPD | IPU |
| 1 | 0 | 0 | UNLOCK(OPEN) SIGNAL TO CPU | | | | | IPD | IPD | IPU |
| 0 | 0 | 0 | UNLOCK (OPEN), REVERSE MOTOR | UNLOCK (OPEN) | | | | IPD | IPD | IPU |
| 1 | 0 | 0 | DO NOTHING | | | CAM SW_2 | LOW TO HIGH | IPD | IPD | IPU |
| 1 | 1 | 0 | STOP | NEUTRAL1 | | | | IPD | IPD | IPU |
| FOR LOCK (CLOSE)SEQUENCE | | | | | UNLOCK (OPEN) | | | | | |
| 1 | 1 | 0 | START | NEUTRAL1 | | CAM SW_3 | LOW TO HIGH | | | |
| 0 | 1 | 0 | LOCK (CLOSE), SIGNAL TO CPU | | | | | | | |
| 0 | 1 | 1 | LOCK (CLOSE) REVERSE MOTOR | LOCK (CLOSE) | | | | | | |
| 0 | 1 | 0 | DO NOTHING | | | CAM SW_2 | HIGH TO LOW | | | |
| 1 | 1 | 0 | DO NOTHING | | | | | | | |
| 1 | 0 | 0 | STOP | NEUTRAL2 | | | | | | |
| FOR UNLOCK (OPEN) SEQUENCE | | | | | LOCK(CLOSE) | | | | | |
| 1 | 0 | 0 | START | NEUTRAL2 | | CAM SW_1 | HIGH TO LOW | | | |
| 1 | 0 | 0 | UNLOCK(OPEN) SIGNAL TO CPU | | | | | | | |
| 0 | 0 | 0 | UNLOCK (OPEN), REVERSE MOTOR | UNLOCK (OPEN) | | | | | | |
| 1 | 0 | 0 | DO NOTHING | | | CAM SW_2 | LOW TO HIGH | | | |
| 1 | 1 | 0 | STOP | NEUTRAL1 | | | | | | |

FIG. 48

MORTISE LOCK APPARATUS AND ELECTRONIC OPERATING SYSTEM

REFERENCE TO RELATED APPLICATIONS

This application is a U.S. National Phase Application under 35 U.S.C. §371 of International Application No. PCT/US2012/035017, filed on Apr. 25, 2012, and claims benefit to U.S. Provisional Patent Application No. 61/518,240, filed on Apr. 25, 2011, the entire disclosures of which are incorporated by reference herein.

COPYRIGHT NOTICE

A portion of this patent document contains material that is subject to copyright protection. The copyright owner has no objection to the facsimile reproduction by anyone of the patent document, as it appears in the Patent and Trademark Office patent files or records, but otherwise reserves all copyright rights whatsoever.

Cross-reference is also made to applicant/assignee's user's manual, "Keeler® Door Locks with SecuRemote™ Technology User Manual," which is incorporated herein by reference.

FIELD OF THE INVENTION

This invention relates generally to the field of security locking devices and access control and more specifically to mechanical and electronically activated access control.

BACKGROUND OF THE INVENTION

Mechanically and/or electromechanically operated doors serve an important function in both commercial and residential contexts ensuring that personnel and/or visitors who are not authorized to access particular premises or secured items are restricted from such access, while providing access to the intended parties. For this purpose, mortise locks have been installed into doors and entryways as a way of concealing a lock's inner workings from access and view. Examples of previous mortise lock designs are disclosed in U.S. Pat. Nos. 3,673,605, 3,808,849, 4,890,870, 4,988,133, 4,950,005, 5,474,348, 6,393,878, and 7,836,738. Traditional mortise lock systems are difficult to install and can often have problems with alignment and smooth function. Exterior fasteners detract from a door's aesthetic and provide intruders with potential entry points in the lock. Additionally, since part of a door's interior must be removed in order to install a mortise lock, traditional locks leave the door weakened and vulnerable to forced entry. Examples of these traditional configurations are shown in FIGS. 45, 46, and 47.

It will be appreciated that this background description has been created by the inventor to aid the reader, and it is not to be taken as a reference to prior art nor as an indication that any of the indicated problems were themselves appreciated in the art.

BRIEF SUMMARY OF THE INVENTION

The disclosure describes, in one aspect, a locking system for a door including a mortise pocket and a centerline. The locking system comprises a mortise case adapted for disposal within the mortise pocket. The mortise case defines an alignment hole. The locking system also has an escutcheon adapted for disposal on the door adjacent the mortise pocket, and a pin adapted for fastening to one side of the escutcheon.

The pin includes an angled cam channel and is shaped to enter the mortise case through the alignment hole such that the angled cam channel is inside the mortise case. The locking system also has a mortise case screw adapted for disposal within the mortise case perpendicular to the pin, wherein one end of the mortise case screw engages the angled cam channel and pulls the escutcheon toward the centerline of the door as the mortise case screw is tightened.

In another aspect, the disclosure describes a locking system for a door including a mortise pocket. The locking system includes a mortise case adapted for disposal within the mortise pocket. The mortise case defines an alignment hole. The locking system also has a gear box and a worm gear disposed within the gear box. The worm gear defines a notched passage that receives a lock knob shaft. A worm within the gear box is coupled to a motor capable of rotating the worm. The worm engages the worm gear such that the worm gear rotates when the worm rotates. A control board disposed within the gear box receives electronic signals and transmits electronic signals to the motor to cause the motor to rotate the worm. The gear box also has a worm gear hub that defines a keyed passage and a hub tab. The worm gear hub is adapted for disposal in the notched passage of the worm gear and the keyed passage is shaped receive the lock knob shaft. The worm gear also has two notches that define the notched passage and the hub tab is adapted to contact the notches individually when the gear hub rotates within the notched passage.

In another aspect, the disclosure describes a locking system for a door including a mortise pocket. The locking system comprises a mortise case adapted for disposal within the mortise pocket and the mortise case defines an alignment hole. The locking system also includes a gear box that defines at least one depression and at least one disc. The disc is adapted to fit partially into the alignment hole of the mortise case and simultaneously fit partially into the depression to ensure proper alignment between the mortise case and the gear box.

In another aspect, the disclosure describes a method of installing a locking system. The method includes providing a door having a mortise pocket and a centerline, positioning a mortise case within the mortise pocket, and placing an escutcheon on the door adjacent the mortise pocket. Additionally, the method includes fastening a pin with an angled cam channel perpendicular to one side of the escutcheon, and positioning the pin within the mortise case such that the angled cam channel is disposed inside the mortise case. The method also includes installing a mortise case screw within the mortise case such that one end of the mortise case screw engages the angled cam channel, and screwing the mortise case screw into the mortise case to pull the escutcheon toward the centerline of the door.

BRIEF DESCRIPTION OF THE SEVERAL VIEWS OF THE DRAWINGS

FIG. 42 is a diagram of the operation of the cam and cam switch system of FIG. 41.

FIG. 43 is a diagram of the operation of the cam and cam switch system of FIG. 41.

FIG. 48 is a diagram of an alternative operation of the cam and cam switch system of FIG. 41.

DETAILED DESCRIPTION OF THE INVENTION

Figure 8:
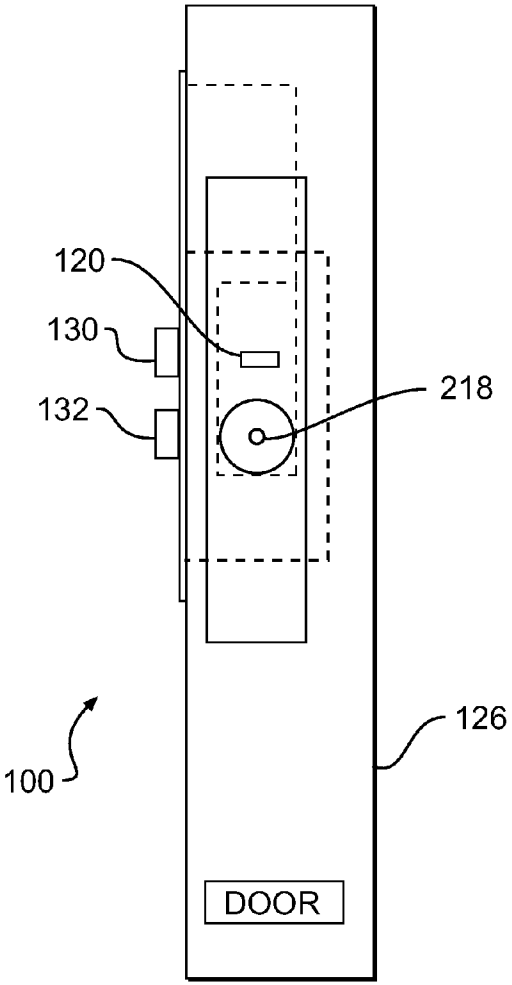
FIG. 8 is a partial schematic view of the locking system of FIG. 1.
Figure 7:
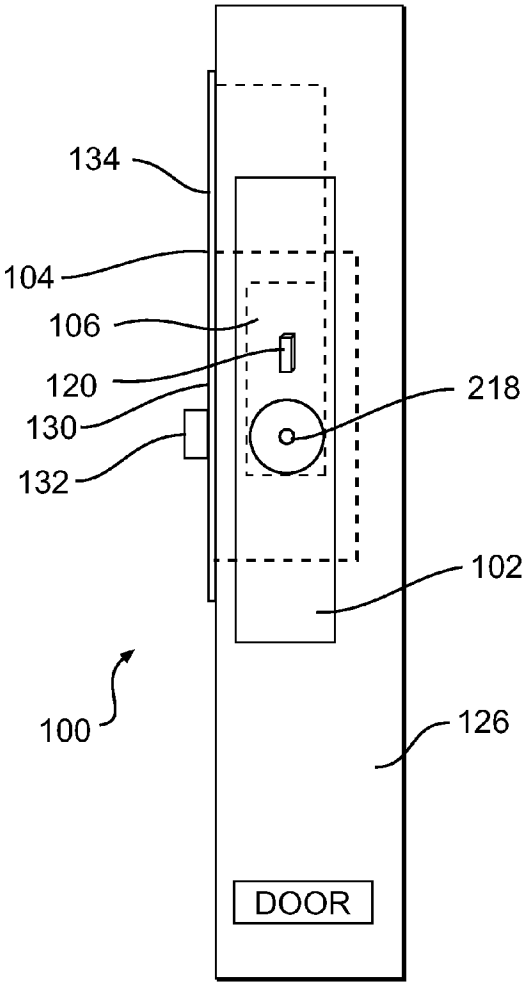
FIG. 7 is a partial schematic view of the locking system of FIG. 1.

This disclosure relates to a locking system 100 that can be implemented into various types of doors or entrances. It should be appreciated that, throughout the discussion and corresponding figures, like reference characters refer to like parts. Any suitable combination of various embodiments can be utilized in the locking system 100 as disclosed herein. FIG. 7 and FIG. 8 provide basic illustrations of the disclosed locking system 100. Hidden lines depict features of the locking system 100 hidden from view. The locking system 100 includes a knob 218, a lock knob 120, a dead bolt 130, a latch bolt 132, an inner escutcheon 102, an outer escutcheon 300, and a strike plate 134. The disclosed locking system 100 is installed into a door 126 or any other type of entryway, and can operate either mechanically or electronically. To operate electronically, the locking system 100 has an electromechanical drive that will be detailed further in this disclosure. The gear box 106 and the mortise case 104 are parts of the electromechanical drive, the hidden outlines of which are illustrated in FIG. 7 and FIG. 8. When the locking system 100 is operated mechanically, a user can turn the knob 218 to actuate the latch bolt 132, and turn the lock knob 120 to actuate the dead bolt 130. When the locking system 100 is operating electronically, the electromechanical drive receives an electronic signal triggering a motor in the gear box 106 to electronically actuate the dead bolt 130. FIG. 7 shows the deadbolt 130 and lock knob 120 in the unlocked position, and FIG. 8 shows the deadbolt and lock knob in the locked position. Both the mechanical and electronic operation of the locking system 100 is disclosed in further detail below.

Figure 3:
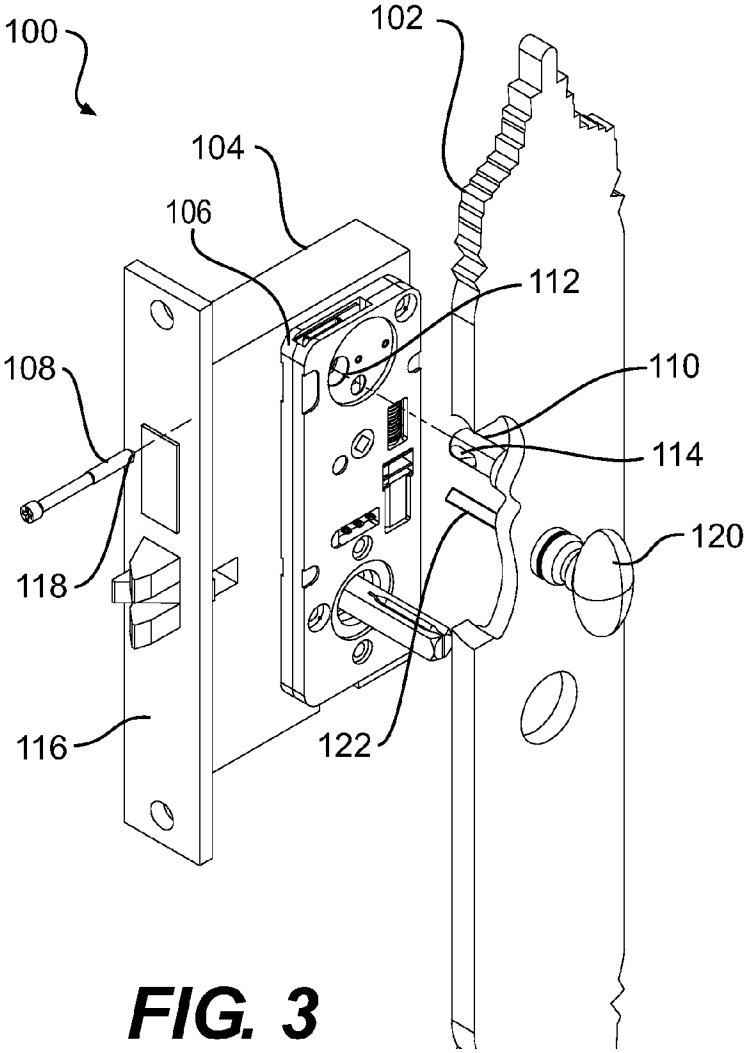
FIG. 3 is a partial exploded view of the locking system of FIG. 1.

The embodiment of the locking system 100 in FIG. 3 shows various pieces of the locking system 100 in an exploded view. This embodiment of the locking system 100 has an inner escutcheon 102, a mortise case 104, and a mortise case screw 108. Although the embodiments illustrated in the figures also feature a gear box 106, some embodiments of the locking system 100 do not include a gear box as it is not always necessary when for the locking system to operate mechanically. The inner escutcheon 102 has a pin 110 protruding perpendicularly from one side of the inner escutcheon toward the mortise case 104. The pin 110 has an angled cam channel 114 machined into the end not connected to the inner escutcheon 102. The pin 110 passes through a pin hole 112 in the gear box 106 and into the mortise case 104 through an alignment hole 208, such that the cam channel 114 resides within the mortise case. The mortise case screw 108 is inserted into the face 116 of the mortise case 104. The mortise case screw 108 has a pointed end 118 that penetrates into the mortise case 104 and into the cam channel 114 in the pin 110. As the mortise case screw 108 is secured into the mortise case 104, the pointed end 118 presses into the angled surface of the cam channel 114, which pulls the inner escutcheon 102 and the parts attached to it towards the door's centerline. The locking system 100 also has a lock knob 120 with a corresponding lock knob shaft 122 that passes through a shaft hole 124 in the gear box 106 and into the mortise case 104. When the pin 110 is aligned with the pin hole 112, the lock knob shaft 122 is aligned to the mortise case 104 and the shaft hole 124. The disclosed design effectively removes all screw-type fasteners from the view of a user.

Figure 4:
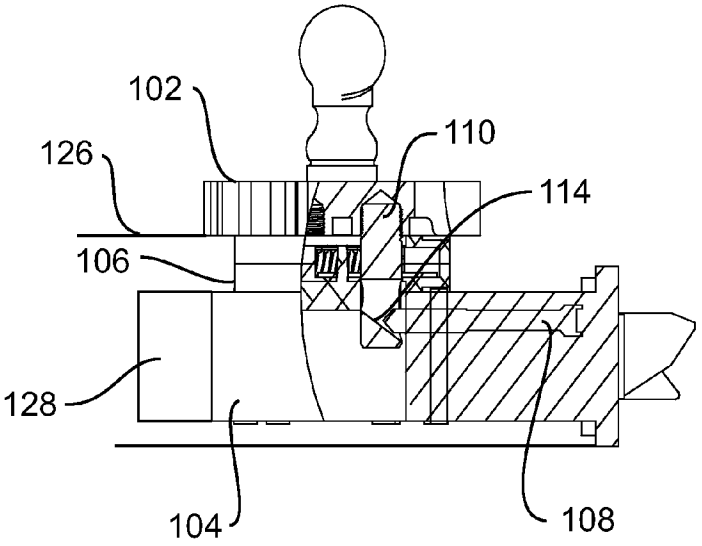
FIG. 4 is a partial cross-sectional view of the locking system of FIG. 1.

FIG. 4 shows a cross-sectional view of the locking system 100 installed within a door 126. The pin 110 is screwed into the inner escutcheon 102 and passes through the gear box 106 into the mortise case 104. The pointed end 118 of the mortise case screw 108 is shown within the mortise case 104 engaging the cam channel 114. The mortise case 104 is assembled into a mortise pocket 128 in the door 126, so when the mortise case screw 104 is tightened, the pin 110 is pulled toward the door's centerline.

Figure 1:
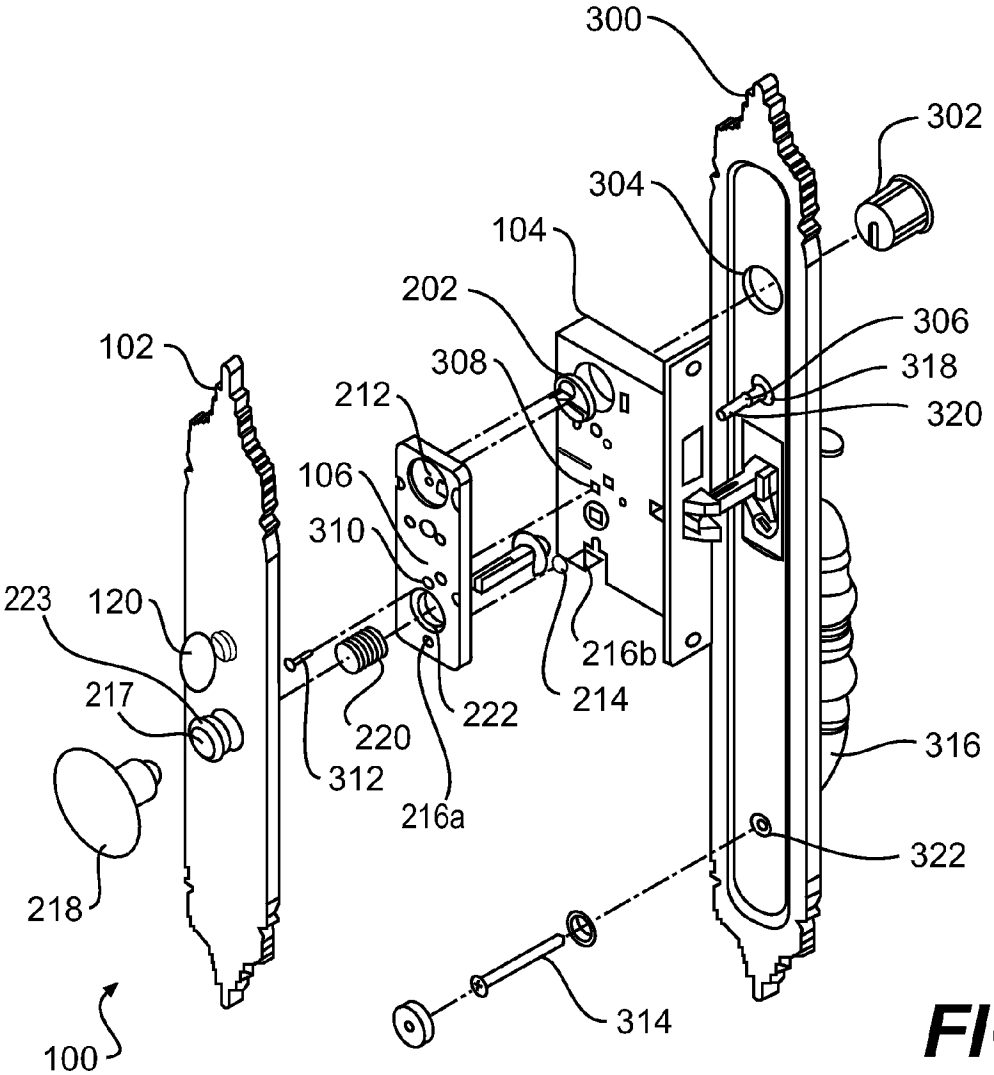
FIG. 1 is an exploded view of a locking system in accordance with the disclosure.
Figure 5:
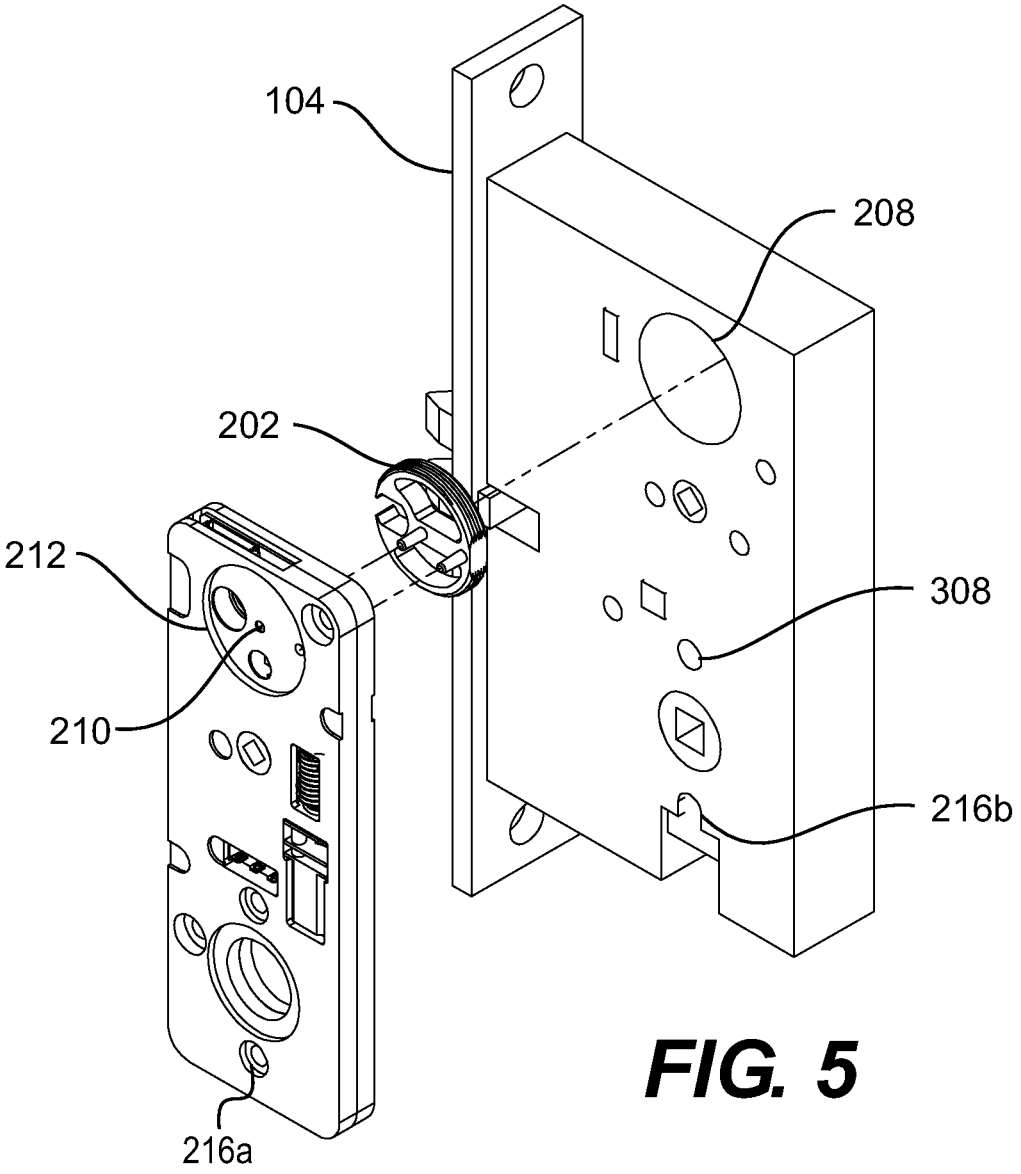
FIG. 5 is a partial exploded view of a mortise case and a gear box in accordance with the disclosure.
Figure 6:
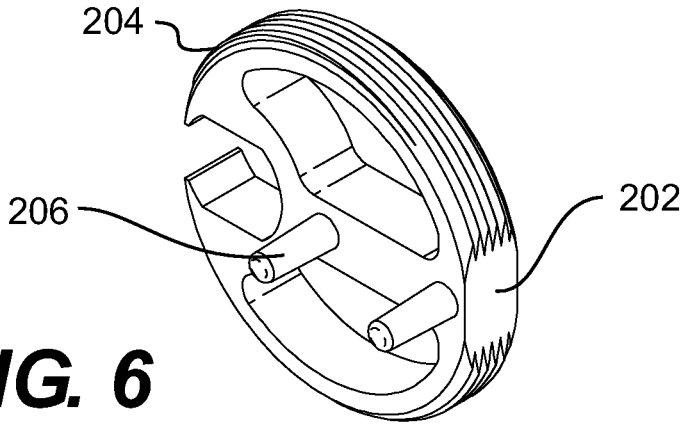
FIG. 6 is a perspective view of a disc in accordance with the disclosure.
Figure 10:
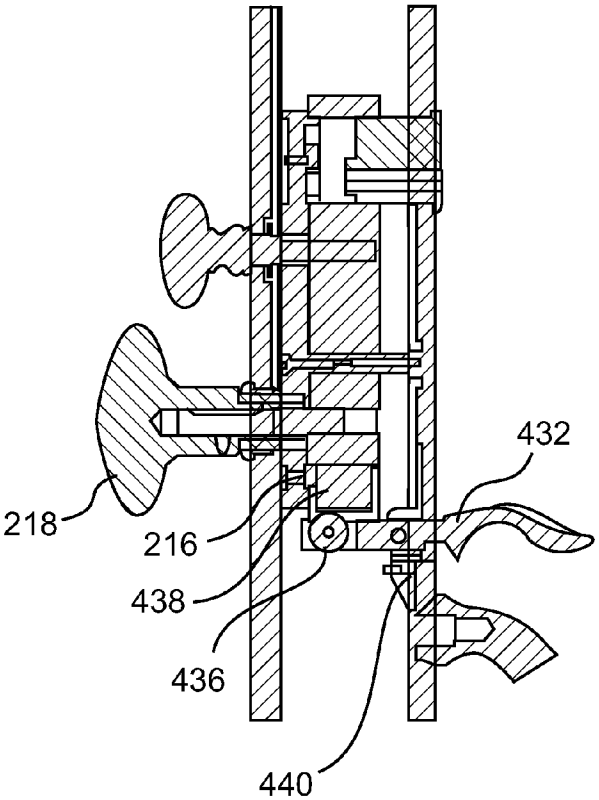
FIG. 10 is a detailed cross-sectional view of the locking system of FIG. 9.
Figure 12:
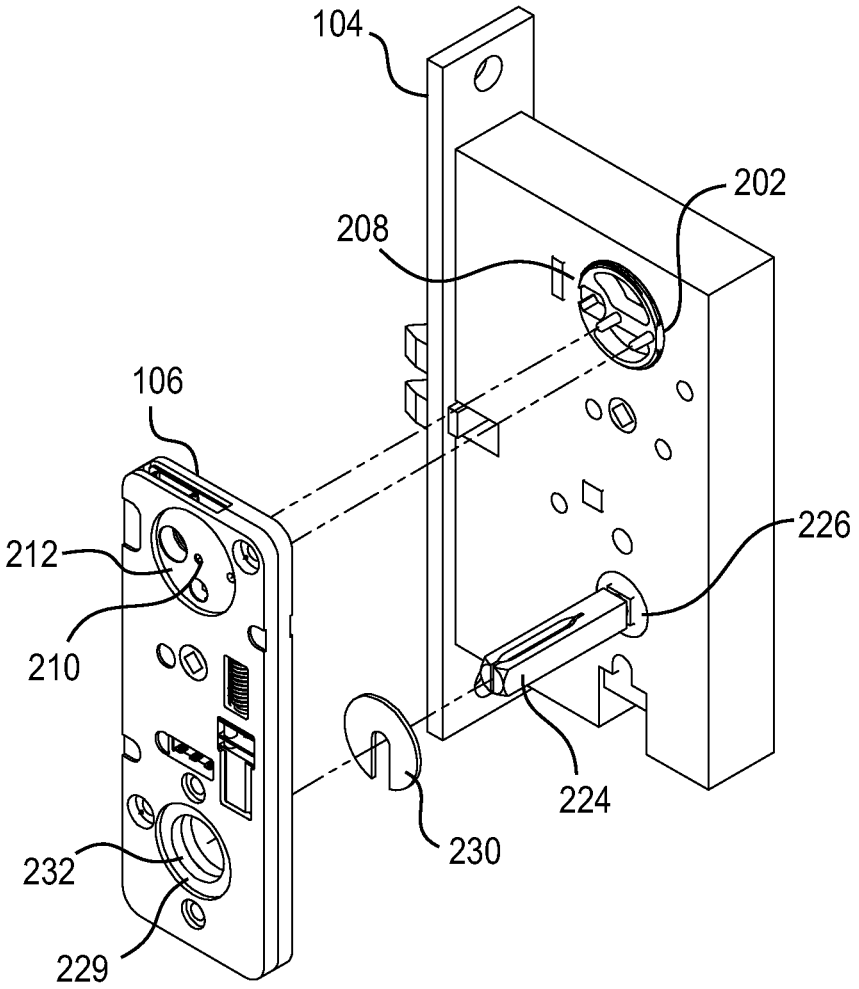
FIG. 12 is a partial exploded view of the mortise case and gear box of FIG. 5.

The disclosure also illustrates several self-alignment features of the inner escutcheon 102 of the locking system 100. FIGS. 5 and 6 show a disc 202 having a threaded area 204 and alignment pins 206 that is assembled into the mortise case 104. The disc 202 threads into the mortise case 104 at the alignment hole 208, as is also shown in FIG. 12. The alignment pins 206 fit into alignment holes 210 in the gear box 106 and the disc 202 fits into a depression 212 in the gear box, aligning the inner escutcheon 102. FIG. 1 shows another exploded view of the locking system 100, including another alignment feature. A bushing 214 is press fit into the gear box 106 at a bushing hole 216*a* and fits into a bushing hole 216*b* in the mortise case 104. The intersection between the bushing 214 and the bushing hole 216 can be seen in FIG. 10. The locking system 100 also includes a knob 218 that passes through the inner escutcheon 102 at a knob passage 217. A threaded tube 220 aligns the inner escutcheon 102 with respect to the gear box 106 by simultaneously fitting into the knob passage 217 and a threaded area 222 on the gear box 106. The knob 218 enters the knob passage 217 of the inner escutcheon 102 and engages the threaded tube 220 and the square shaft 224. The knob 218 can be secured to the square shaft 224 with a set screw. Therefore, the knob 218 and inner escutcheon 102 are properly aligned with respect to the gear box 106 and the mortise case 104 because the gear box 106 is aligned by the disc 202 and the bushing 214.

Figure 13:
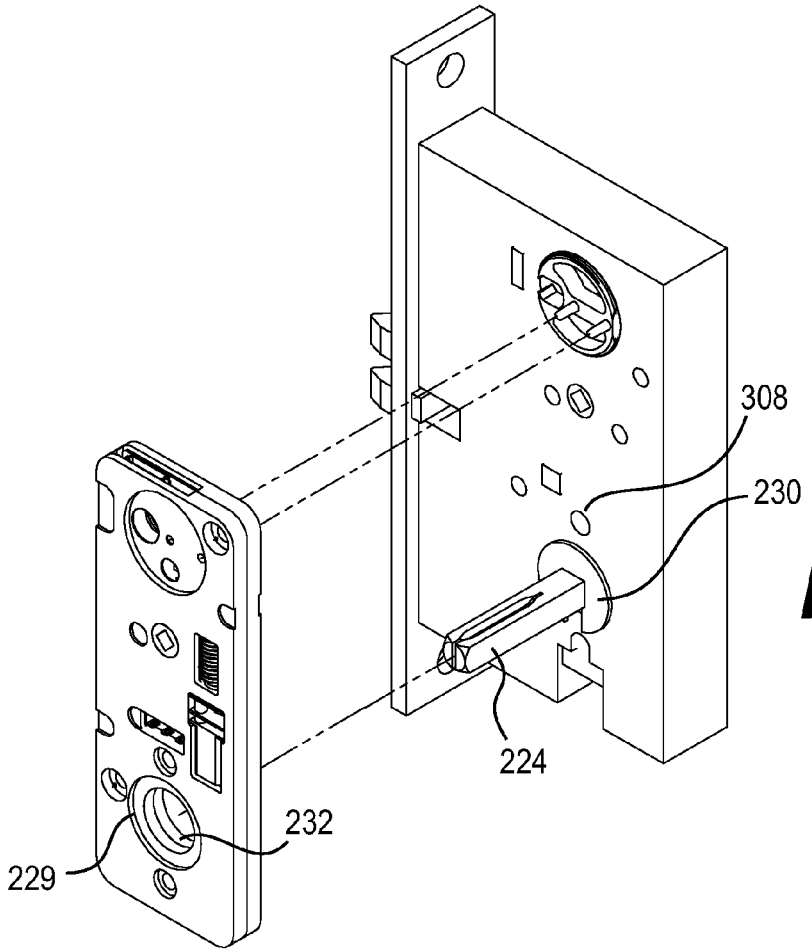
FIG. 13 is a partial exploded view of the mortise case and gear box of FIG. 5.
Figure 14:
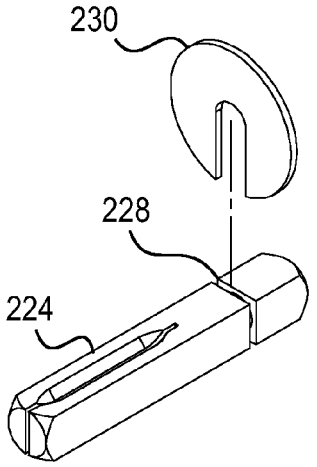
FIG. 14 is an exploded view of a square shaft and a slotted washer in accordance with the disclosure.

FIG. 12, FIG. 13, and FIG. 14 show additional alignment features of the locking system 100. A square shaft 224 is assembled into the mortise case 104 at a shaft receptacle 226. The square shaft 224 has a groove 228 near the end of the square shaft that attaches to the mortise case 104. The gear box 106 has a shaft hole 229 with a counterbore creating a recessed area 232. A slotted washer 230 fits into the groove 228 and rests in the recessed area 232 on the gear box 106. This prevents the square shaft 224 from being pulled out from the mortise case 104 when the gear box 106 and the mortise case are drawn together.

Figure 2:
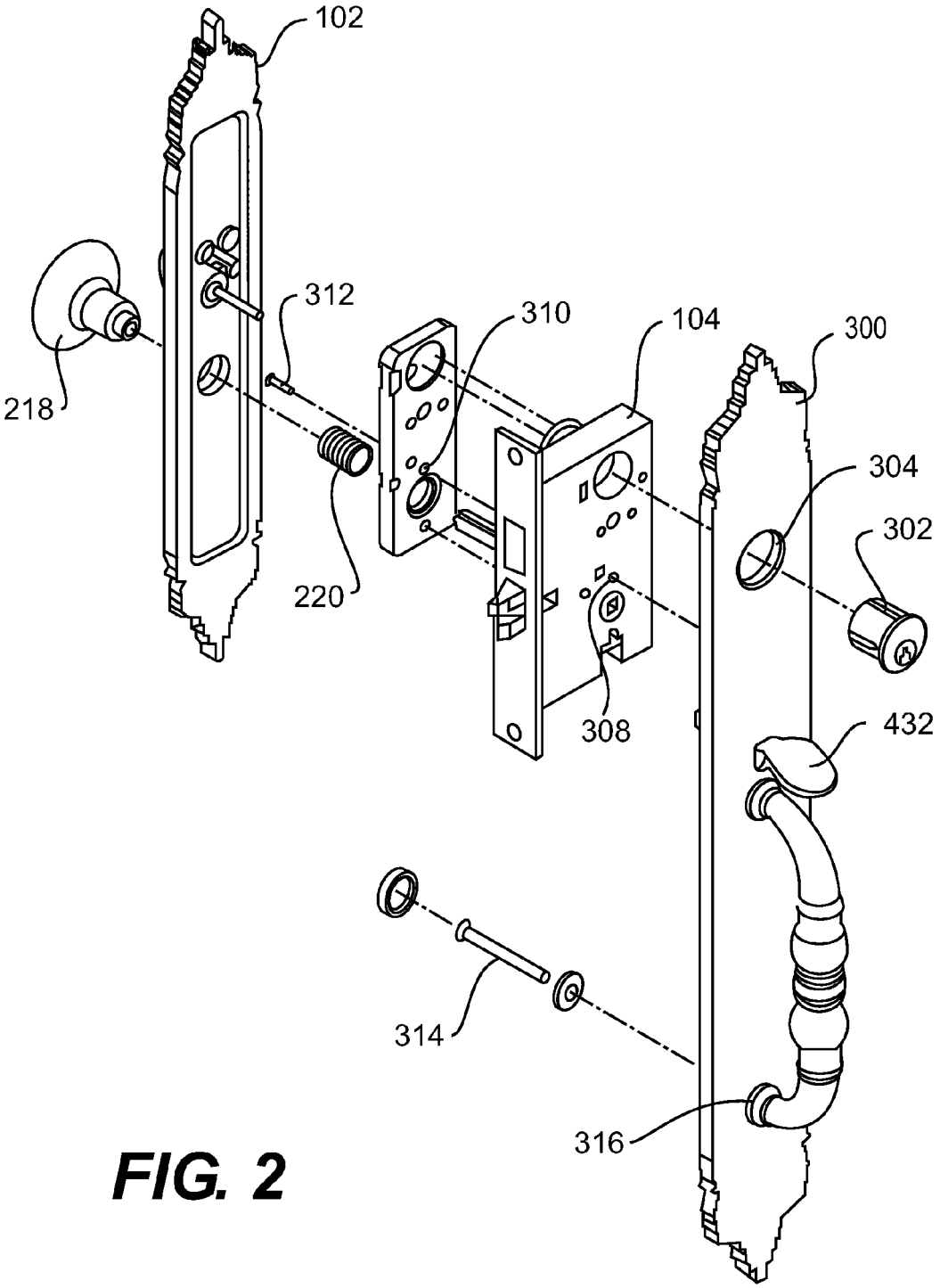
FIG. 2 is an exploded view of the locking system of FIG. 1.
Figure 9:
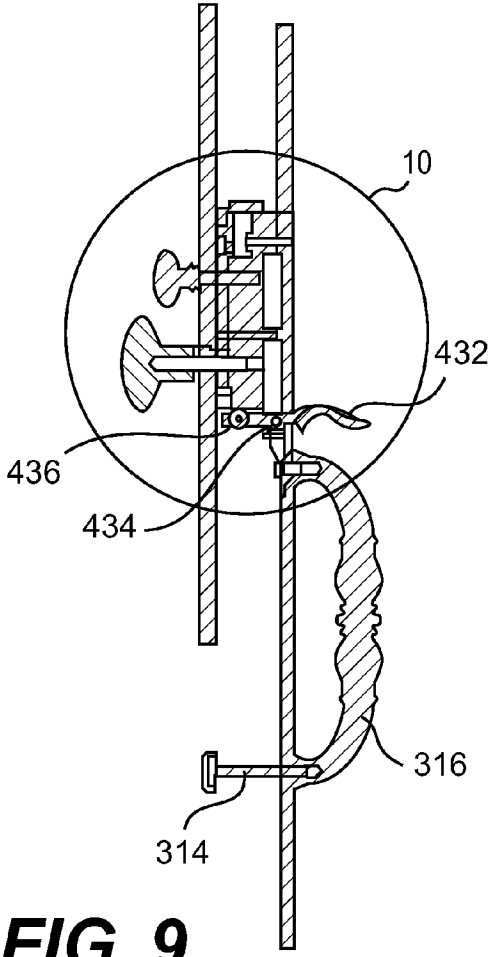
FIG. 9 is a cross-sectional view of the locking system of FIG. 1.

The locking system 100 also features an outer escutcheon 300 that utilizes several alignment features that aid in the installation and function of the locking system 100. One such outer escutcheon is shown in FIG. 1 and FIG. 2. A lock cylinder 302 fits through a lock hole 304 in the outer escutcheon 300 and screws into the mortise case 104 at the alignment hole 208. Additionally, an aligning pin 306 is threaded or otherwise attached to the outer escutcheon 300. The aligning pin 306 passes through a hole in the door's 126 exterior, through an aligning pin hole 308 in the mortise case 104, and through an aligning pin hole 310 in the gear box 106. A pin screw 312 fits into the end of the aligning pin 306 and fastens the aligning pin in place. The outer escutcheon 300 is also fastened by a handle screw 314. The handle screw 314 passes through the door 126 and is tightened into a handle assembly 316, which serves to hold the outer escutcheon against the outer surface of the door 126. FIG. 9 shows a sectional view of an embodiment of the locking system 100, illustrating the handle screw 314 fastened into the handle assembly 316. The outer escutcheon 300 also has a hex outer drive area 322 where the handle screw 314 enters the outer escutcheon. The hex outer drive area 322 allows sufficient force to be applied to the handle assembly 316.

The aligning pin 306 is cylindrical and has a larger diameter at its base 318 where it attaches to the outer escutcheon 300 than its diameter at the opposite threaded end 320. The diameter of the aligning hole 308 in the mortise case 104 is smaller than that of the base 318, but larger than that of the threaded end 320. The larger diameter at the base 318 further aids in aligning the outer escutcheon 300 as the base is not able to pass through the mortise case 104. The larger base 318 diameter that prohibits entry into the mortise case 104 also enhances the security of the locking system 100. If a forced entry is attempted and causes the aligning pin 306 to fail where it is attached to the outer escutcheon, the larger base 318 diameter allows the aligning pin act as a nut and bolt.

In addition to the alignment enhancements served by the aforementioned alignments and fastenings, they also serve to enhance the strength of the locking system 100 and door 126. Instead of merely decorative members, the described fastening system causes the inner escutcheon 102 and the outer escutcheon 300 to become stress-bearing members. The inner escutcheon 102 and outer escutcheon 300 are pulled toward one another to form a bridge sandwich assembly adding strength to the entire locking system 100 and helping prevent forced entry. Additionally, in some embodiments, the locking system 100, when installed on a closed door, has no exterior screws on the inner escutcheon 102 or outer escutcheon 300. This enhances both the aesthetics and security of the locking system 100.

Figure 15:
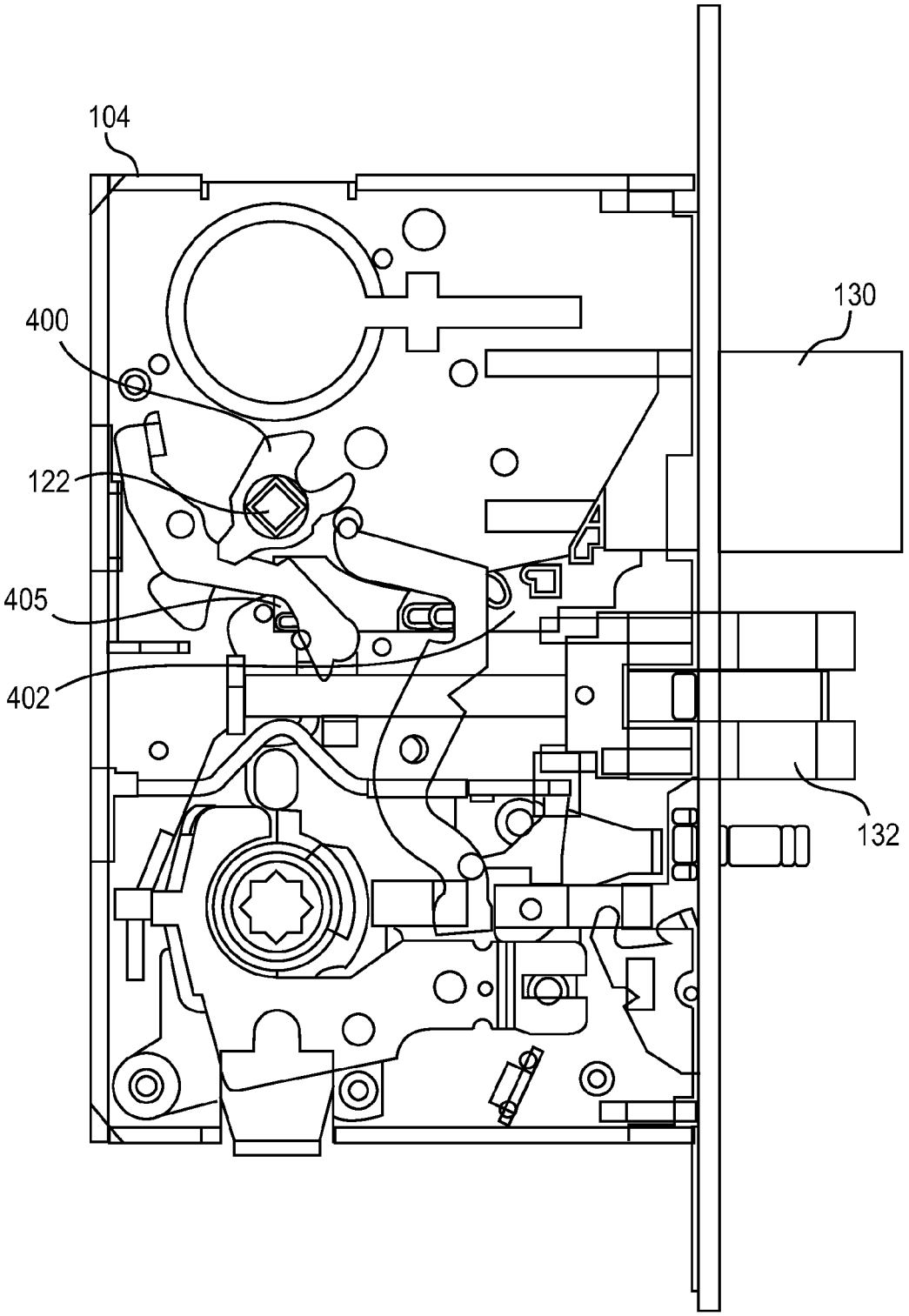
FIG. 15 is a cross-sectional view of the mortise case of FIG. 5.

The disclosed locking system 100 includes additional improvements to the mortise case 104 that improve its reliability, decrease friction, or provide other benefits. FIG. 15 depicts a sectional view of an embodiment of the mortise case 104. The mortise case 104 includes a pawl 400, which is put in motion by a lock knob 120 or lock cylinder 302. The pawl, shown in more detail in FIG. 21, has a rounded bottom end 401 and defines a keyway 403. When a user turns the lock knob 120, the lock knob shaft 122 acts on the pawl 400 via the keyway 403. As the pawl 400 turns, it acts on a proximate end 405 of a locking bolt 402 that connects to the dead bolt 130 at a distal end 407. When the pawl 400 moves, it pushes or pulls the locking bolt 402 depending on whether a user is locking or unlocking the locking system 100. In the locked position, the dead bolt 130 protrudes out the face 116 of the mortise case 104. In the unlocked position, the dead bolt 130 retracts into the mortise case 104. A tension spring 404 attaches to the locking bolt 402 and biases the pawl 400 in either the locked or unlocked position.

Figure 16:
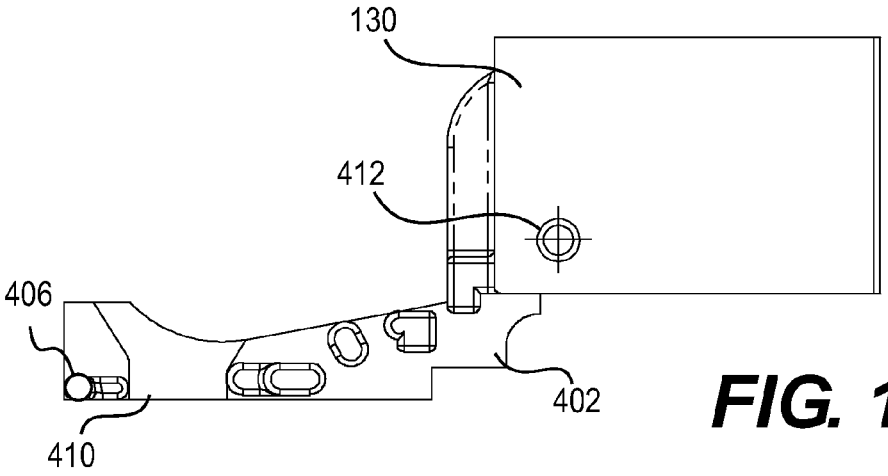
FIG. 16 is a partial side view of a locking bolt in accordance with the disclosure.
Figure 17:
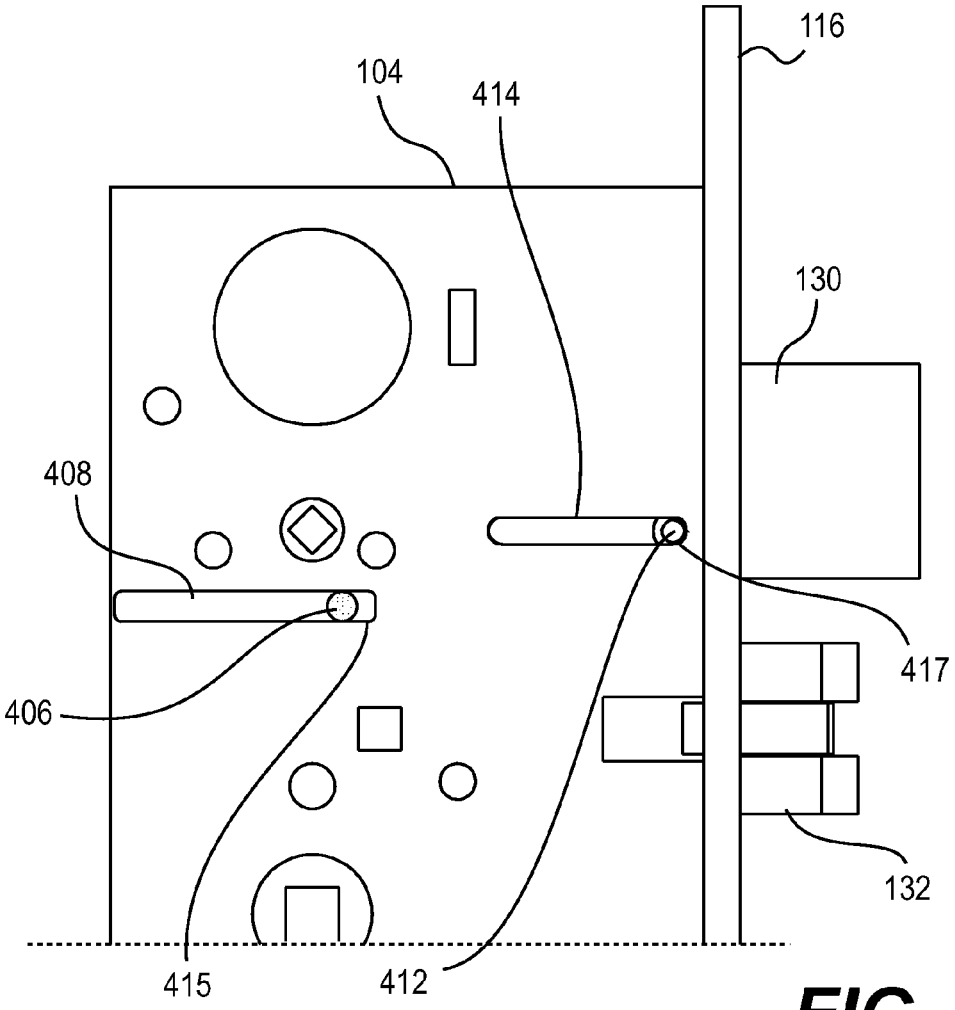
FIG. 17 is a partial side view of a mortise case in accordance with the disclosure.
Figure 18:
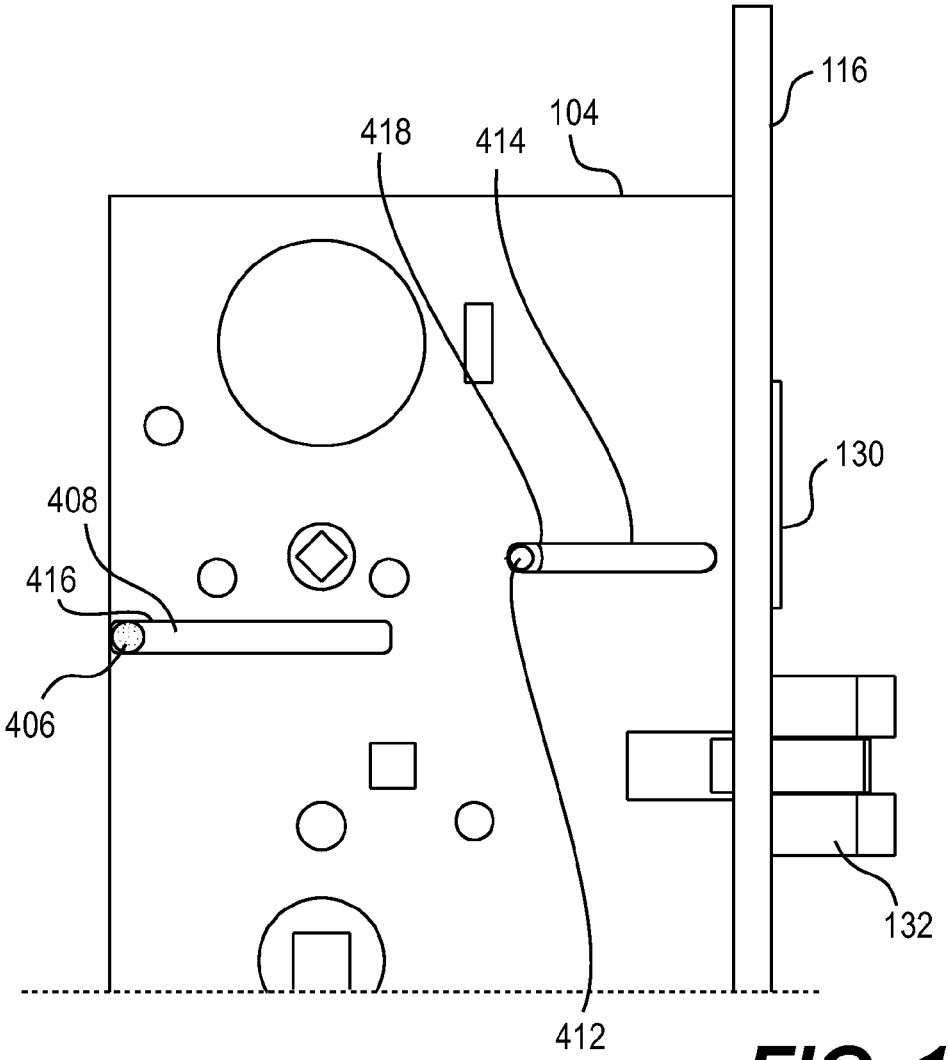
FIG. 18 is a partial side view of the mortise case of FIG. 17.

FIG. 16 and FIG. 17 show an embodiment of the disclosed locking bolt 402 and the locking bolt in the mortise case 104 in the locked position. The locking bolt 402 includes a locking bolt pin 406 that fits through the mortise case 102 in a rear slot 408. The locking bolt pin 406 controls and stabilizes the rear section 410 of the locking bolt 402. Additionally, the locking bolt 402 has a dead bolt pin 412 at the dead bolt 130 that protrudes through the dead bolt and the mortise case 104 at a front slot 414. Both the locking bolt pin 406 and the dead bolt pin 412 improve the linear action of the dead bolt 130 and locking bolt 402. In the locked position, the locking bolt pin 406 is positioned at the front end 415 of the rear slot 408. Likewise, in the locked position, the dead bolt pin 412 is located at the front end 417 of the front slot 414. FIG. 18 shows the locking bolt 402 in the mortise case 104 in the unlocked position. In the unlocked position, the locking bolt pin 406 is positioned at the opposite end of the rear end 416 of the rear slot 408. Likewise, in the unlocked position, the dead bolt pin 412 is in the rear end 418 position of the front slot 414.

Figure 19:
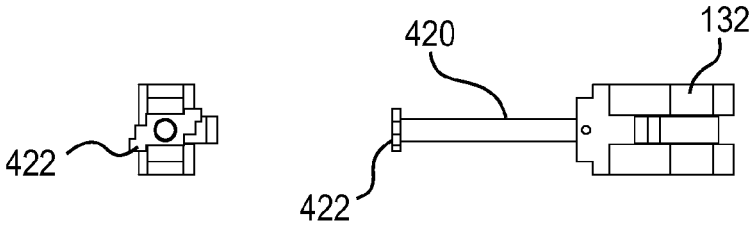
FIG. 19 is a front and side view of a latch bolt arm in accordance with the disclosure.
Figure 20:
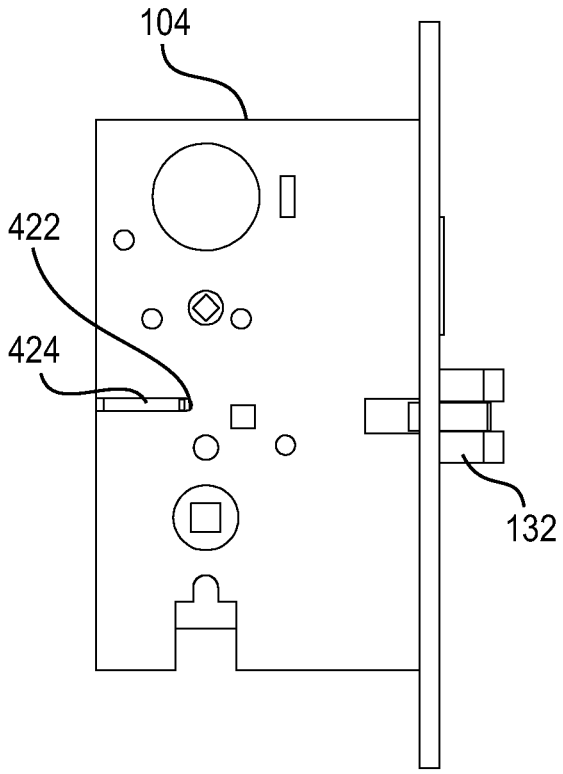
FIG. 20 is a partial side view of a mortise case in accordance with the disclosure.

The disclosed locking system 100 also features improved linear tracking and stabilization of the latch bolt 132. FIG. 19 shows the latch bolt arm 420 connected to the latch bolt 132, and FIG. 20 shows the latch bolt arm in the mortise case 104. The latch bolt arm 420 has an alignment tab 422 at the end opposite the latch bolt 132. The alignment tab 422 fits into a tab slot 424 in the mortise case 104 and aligns the latch bolt 132. The alignment tab 422 also provides a status indicator for a switch for operating the electromechanical drive, which will be described in further detail below.

Figure 22:
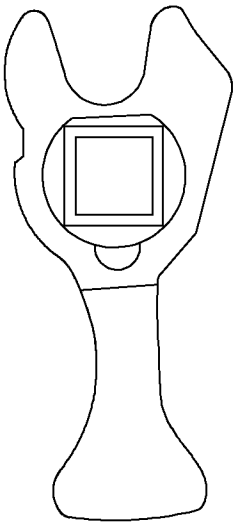
FIG. 22 PRIOR ART
FIG. 22 is a front view of a pawl in the prior art.
Figure 21:
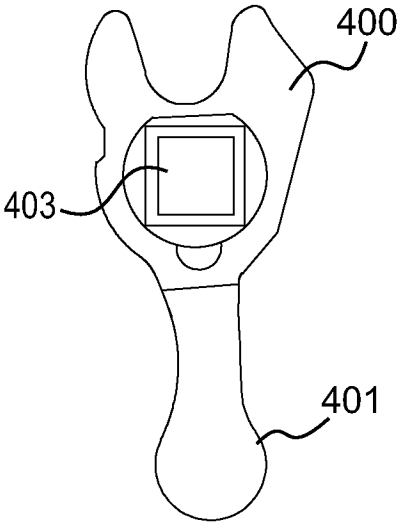
FIG. 21 is a front view of a pawl in accordance with the disclosure.

FIG. 21 shows an embodiment of the pawl 400. The disclosed pawl 400 has a bottom end 401 shaped with a continuous curve. The smooth, continuous curve around the bottom end 401 results in linear forces as the lock knob 120 is turned either mechanically by a user or electronically by the electromechanical drive. Previous pawl designs, like the one shown in FIG. 22, have resulted in extremely non-linear forces.

Figure 24:
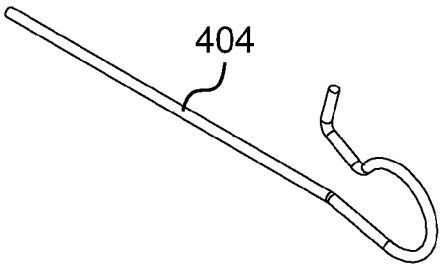
FIG. 24 is a perspective view of the tension spring of FIG. 23.
Figure 23:
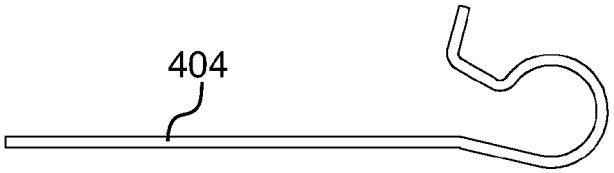
FIG. 23 is a side view of a tension spring in accordance with the disclosure.
Figure 25:
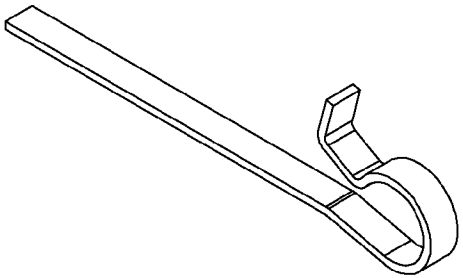
FIG. 25 PRIOR ART
FIG. 25 is a perspective of a tension spring in the prior art.

FIG. 23 and FIG. 24 show an embodiment of the tension spring 404 that biases the pawl 400 in either a locked or unlocked position. Previous tension spring designs are flat, which causes higher friction to the mechanism and improperly steers the pawl. An example of a previous design is shown in FIG. 25. The disclosed tension spring 404 has a round, cylindrical shape as depicted in FIG. 24. The rounded tension spring 404 creates less friction on the various parts within the mortise case 104. Older mortise case designs required a flat tension spring to hold them in alignment to the locking bolt. The mortise case 104 in this disclosure, however, does not require alignment provided from the tension spring 404 due to the added alignment features discussed above, such as the locking bolt pin 406 and the dead bolt pin 412.

Figure 27:
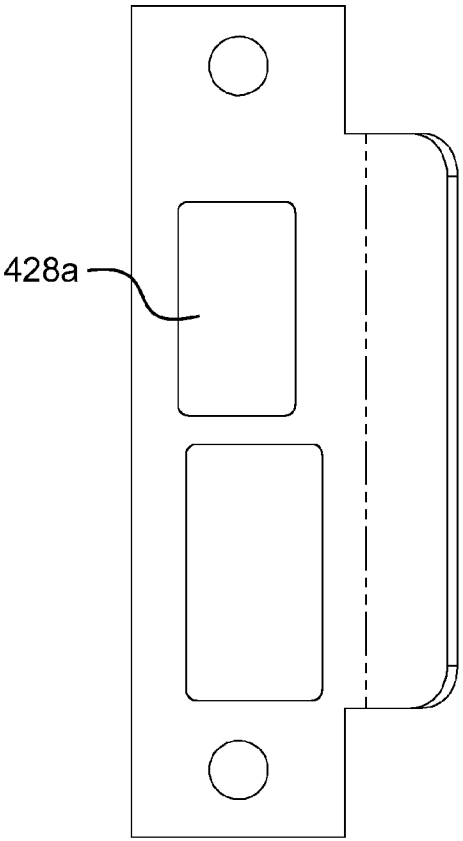
FIG. 27 is a front view of a strike plate in the prior art.
Figure 26:
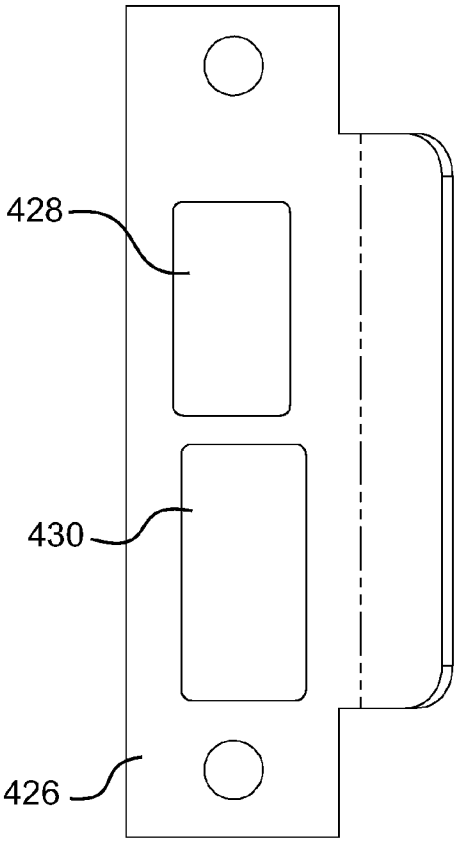
FIG. 26 is a front view of a strike plate in accordance with the disclosure.

FIG. 26 shows an embodiment of a strike plate 426 that covers the face 116 of the mortise case 104. The strike plate 426 has two rectangular slots: a bolt slot 428 and a latch slot 430. The rectangular slots facilitate securing the dead bolt 130 and the latch bolt 132 in the door jamb. The disclosed strike plate 426 features a bolt slot 428 that is wider than the bolt slots in previous designs. An example of a previous design is shown in FIG. 27 having a narrower bolt slot **428*a*. The wider bolt slot 428 in this disclosure allows the latch bolt 132 to hold the door 126 in place and allows the dead bolt 130** to move more freely into the retention area in the door jamb.

Figure 11:
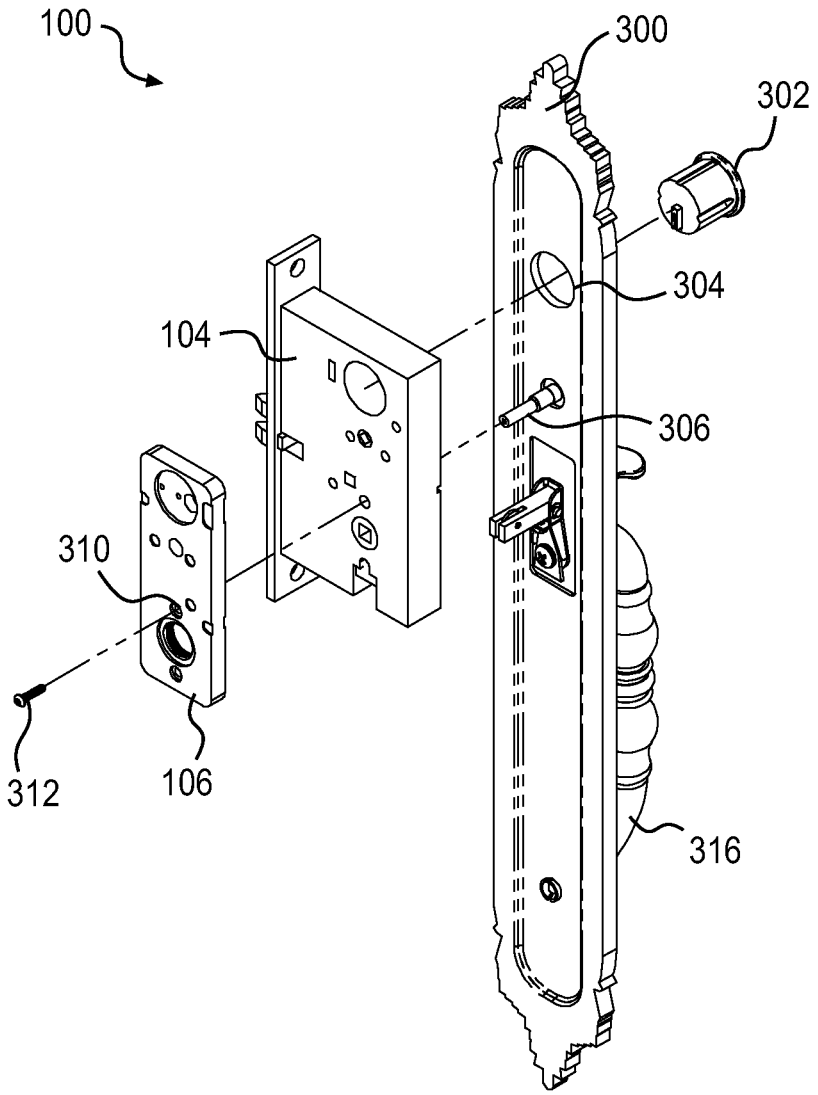
FIG. 11 is a partial exploded view of the locking system of FIG. 1.

Another aspect of the disclosure that provides improvements in user interaction by creating less friction is the thumb piece 432. Referring to FIG. 9 and FIG. 11, in one embodiment of the locking system 100, the thumb piece 432 fits through the outer escutcheon 300 above the handle assembly 316. The user presses down on the thumb piece 432, causing a thumb lever 434 to move upwards. The thumb lever 434 has a roller 436 that engages a mortise case member 438 as the thumb lever moves upwards. The movement of the mortise case member 438 causes the latch bolt 132 to retract into the mortise case 104 or protrude out of it. The roller 436 decreases the friction between the thumb lever 434 and the mortise case member 438.

Figure 31:
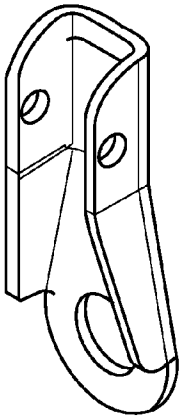
FIG. 31 PRIOR ART
FIG. 31 is a perspective view of a bracket in the prior art.
Figure 33:
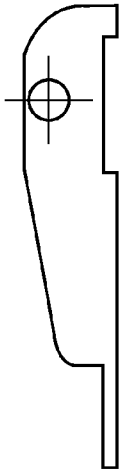
FIG. 33 PRIOR ART
FIG. 33 is a side view of the bracket of FIG. 31.
Figure 32:
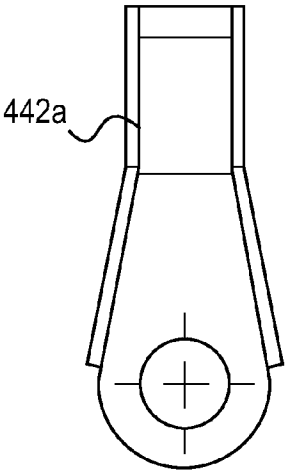
FIG. 32 PRIOR ART
FIG. 32 is a front view of the bracket of FIG. 31.
Figure 30:
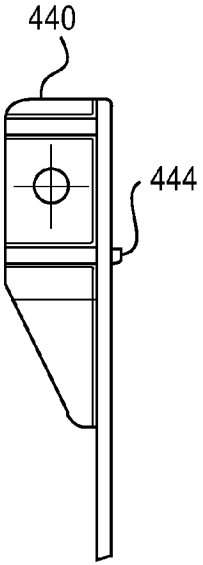
FIG. 30 is a side view of the bracket of FIG. 28.
Figure 28:
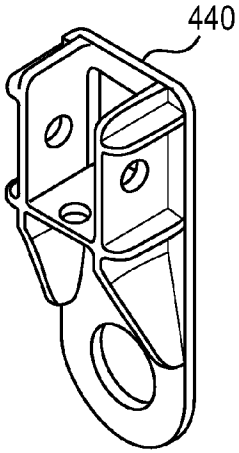
FIG. 28 is a perspective view of a bracket in accordance with the disclosure.
Figure 29:
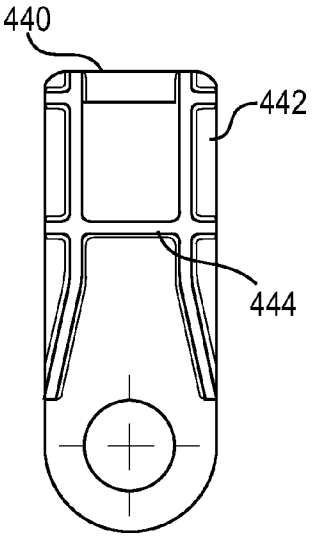
FIG. 29 is a front view of the bracket of FIG. 28.

FIG. 28, FIG. 29, and FIG. 30 show additional improvements to the bracket 440 in the thumb piece 432 of this disclosure. The bracket 440 engages with the thumb piece 432 and has a collar 442. In a previous design, the bracket **440*a*, shown in FIG. 31, FIG. 32, and FIG. 33, tends to pivot about the bracket's mounting hole. This pivoting causes friction in the bracket's 440*a* collar 442*a*. The disclosed design features an extended area 444**, which stabilizes the pivoting motion and decreases or eliminates this friction.

It will be appreciated that the disclosed locking system 100 can also feature an electromechanical drive such that the system can be locked or unlocked electronically with any device such a wireless cell connection, a radio frequency identification (RFID) connection, Bluetooth™ connection, etc. Examples of these devices are cellular phones, garage door openers, or any other type of remote signaling device. The electronic components and drive components fit inside the door 126 structure, allowing the electronic system to look no different than a normal mechanical locking system.

Figure 34:
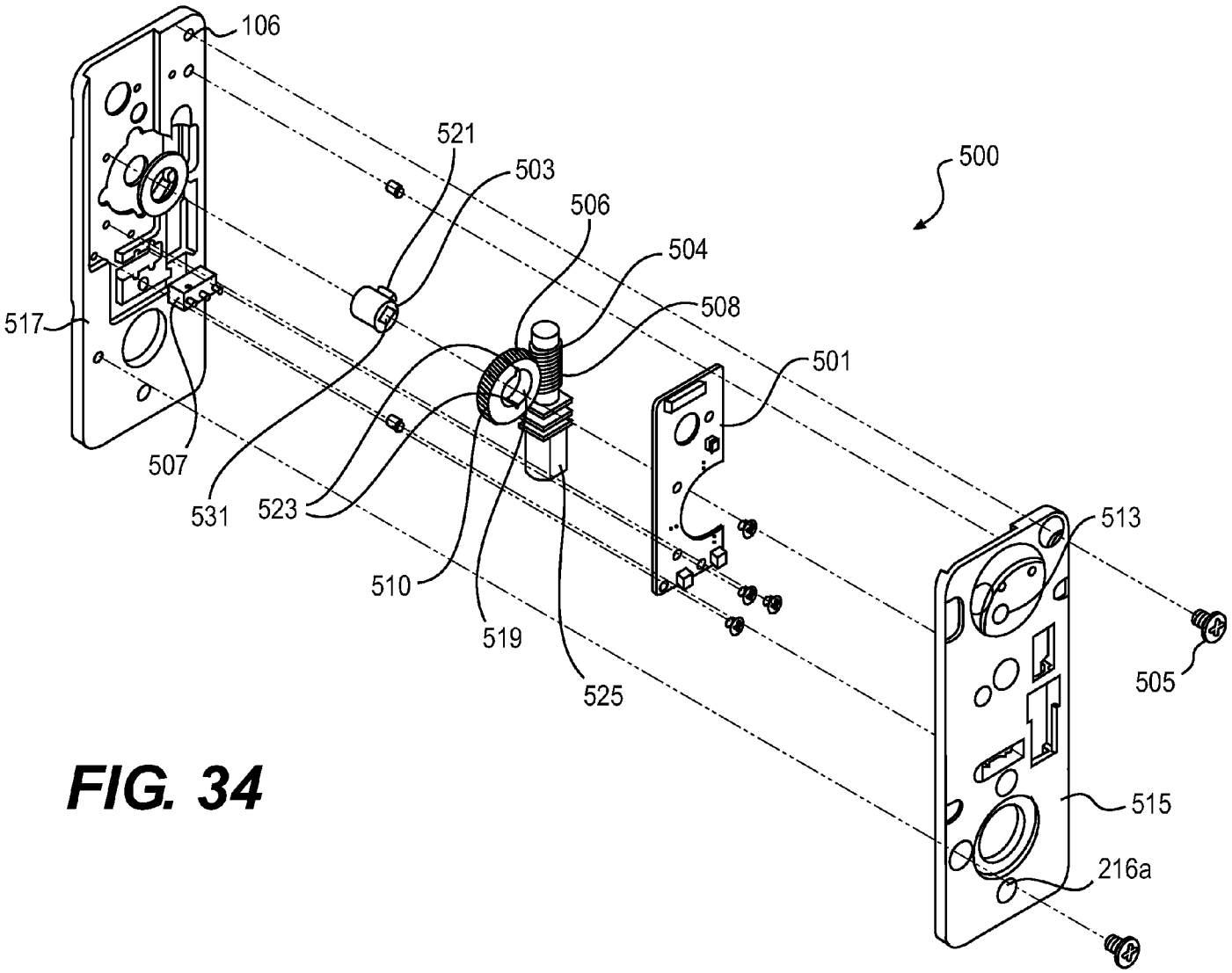
FIG. 34 is an exploded view of a gear box in accordance with the disclosure.

FIG. 34 shows an exploded view of the embodiment of the gear box 106 that houses the electromechanical drive 500 system. The gear box 106 has a control board 501 that is configured to receive signals from a central processing unit (CPU) 502 shown in FIG. 35 and FIG. 36. The gear box 106 has a first shell 515 and a second shell 517 held together by gear box fasteners 505. The gear box 106 also has a worm 504, a motor 525, a worm gear 506, a worm gear hub 503, and a latch switch 507 positioned between the first shell 515 and second shell 517. The worm 504 has spiral teeth 508 that mate with gear teeth 510 on the worm gear 506. The worm gear 506 also forms a notched passage 519 in its interior into which the worm gear hub 503 fits, and the worm gear hub forms a keyed passage 531. The worm gear hub 503 engages the notched passage 519 such that the worm gear hub can rotate within the notched passage in either direction until a hub tab 521 contacts notches 523 on the interior of the worm gear 506.

When the control board 501 receives the appropriate signal from the CPU 502, the control board sends a signal to the motor 525, causing the worm 504 to rotate in a specified direction, either clockwise or counter clockwise. When the worm 504 rotates in either direction, it causes the worm gear 506 to rotate in a direction dependent upon the worm's direction of rotation. Rotation of the worm gear 506 causes the worm gear hub 503 to rotate when one of the notches 523 of the worm gear contacts the hub tab 521. The lock knob shaft 122 fits into the keyed passage 531 of worm gear hub 503, causing the lock knob shaft and the lock knob 120 to rotate when the worm gear hub rotates. Alternatively, the lock knob shaft 122 can be geared to rotate based on rotation of the worm 504 instead of fitting into the worm gear hub 503. Since the lock knob shaft 122 acts on the pawl 400 to actuate the locking bolt 402 and dead bolt 130, the worm's 504 rotation in response to signals from the CPU 502 actuates the dead bolt. Therefore, an electronic signal to the control board 501 can cause the dead bolt to move to the locked position or the unlocked position using the electromechanical drive 500.

The control board 501 has location switches that determine the dead bolt's 130 position as either locked or unlocked. After the worm gear hub 503 rotates the lock knob shaft 122 into the locked position, the worm 504 rotates the worm gear 506 into a neutral position where the hub tab 521 is not contacting either notch 523 or at least the worm gear is not rotating the gear hub 503. In the neutral position, the dead bolt's 130 lock/unlock position is unaffected. Likewise, after the worm gear 506 rotates the lock knob shaft 122 to the unlocked position, the worm gear then rotates back to the neutral position. When in the neutral position, a user can mechanically access and operate the locking system 100 to lock or unlock the by manually turning the lock knob 120. The CPU 502 is capable of receiving wireless signals containing instructions to move the dead bolt 130 into and out of the lock/unlock positions. The CPU receives a wireless signal from any type of wireless device, such as a cell phone, garage door opener, or key fob, processes the signal, and transmits instructions to the control board 502. While the CPU 502 can receive signals using Bluetooth™ technology, the wireless operating device can also include a software application that allows the wireless device to pair with the CPU securely with the Bluetooth™ transmitting function temporarily turned off. The control board 502 receives the electronic instructions from the CPU and transmits the proper signal to the motor 525 instructing it to rotate the worm 504 to cause the dead bolt 130 to move to either the lock or unlock position, depending on the instruction.

Figure 41:
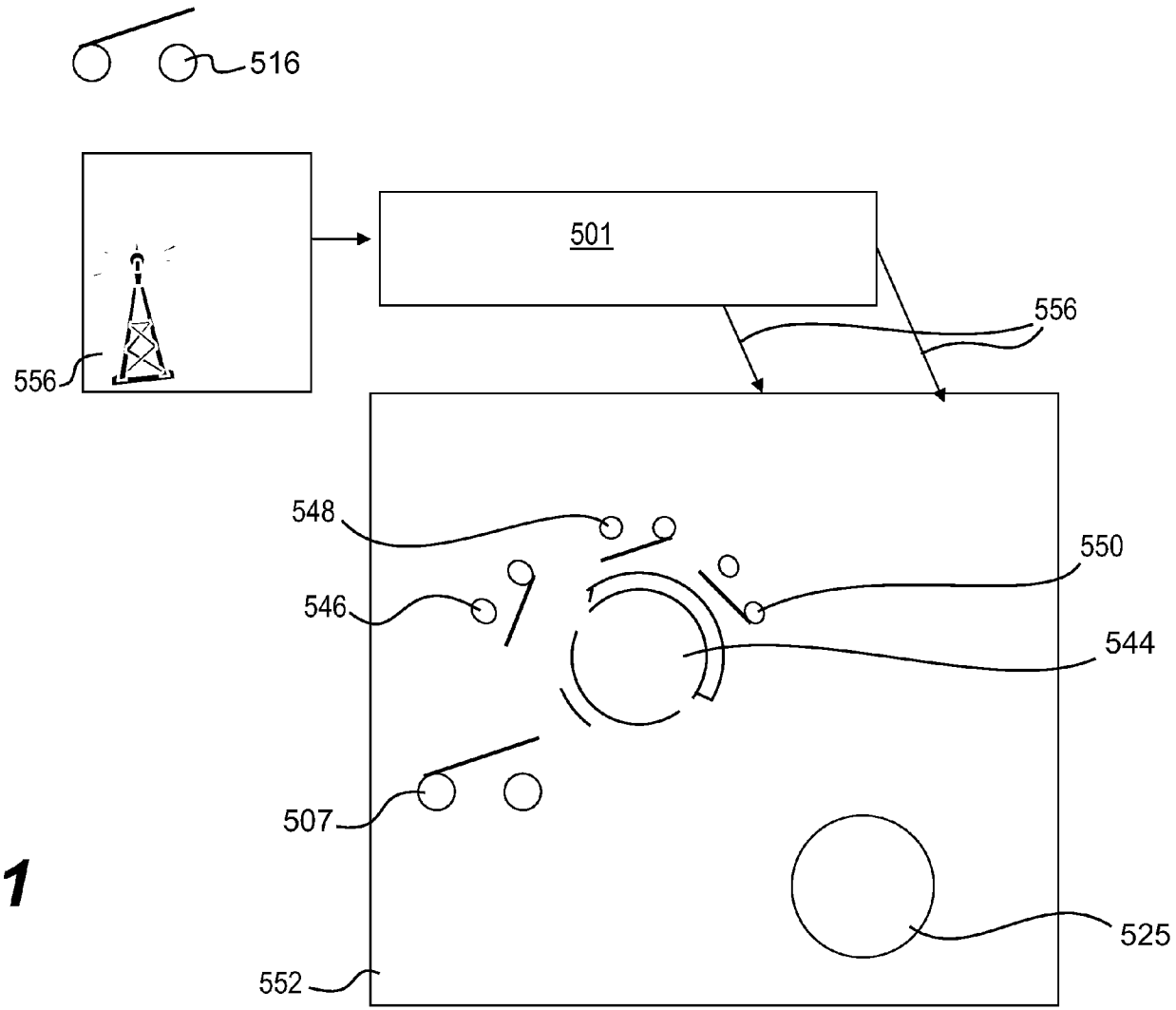
FIG. 41 is a block diagram of a cam and cam switch system in accordance with the disclosure.
Figure 44:
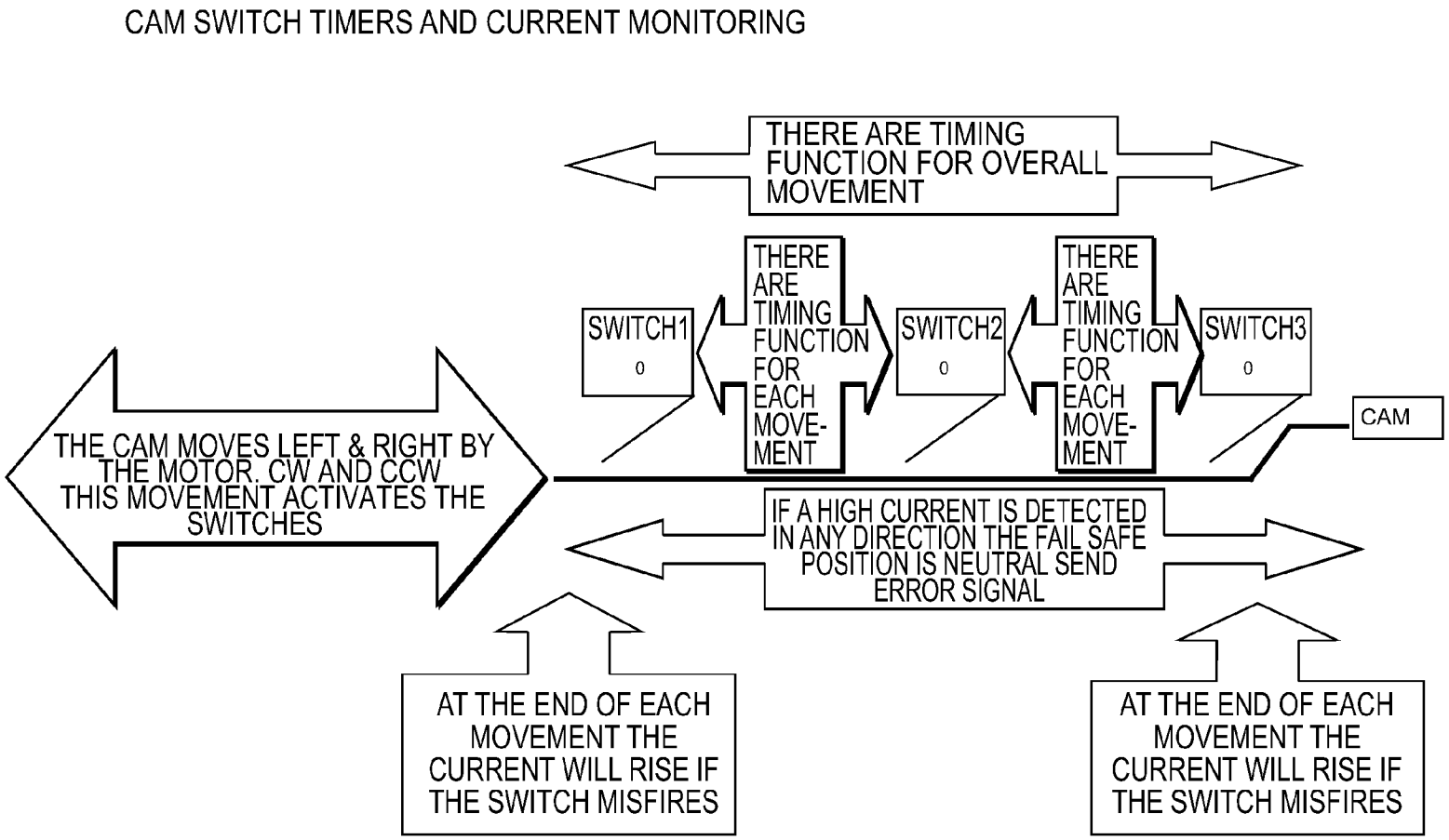
FIG. 44 is a flow chart of cam switch timers and current monitoring in accordance with the disclosure.
Figure 45:
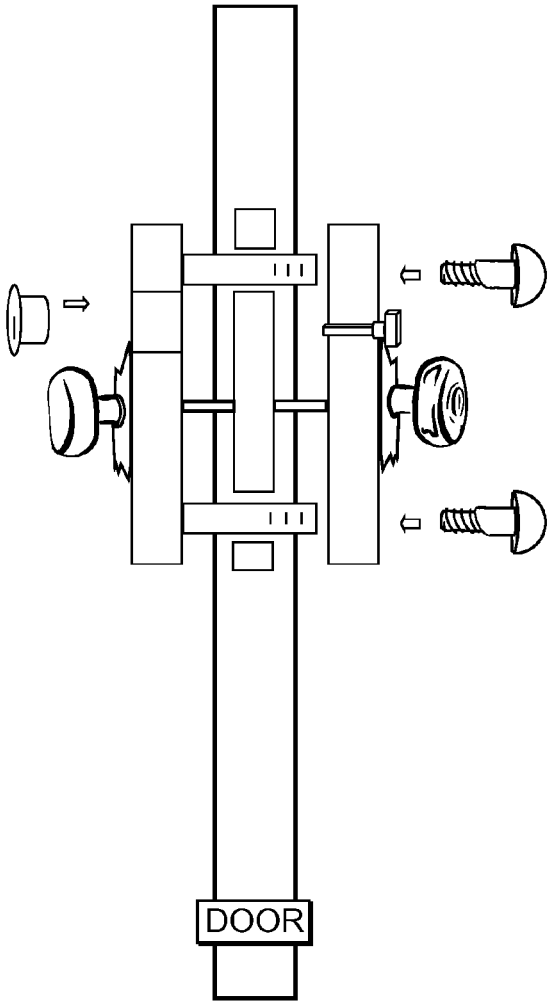
FIG. 45 PRIOR ART
FIG. 45 is a schematic of a mortise locking system in the prior art.
Figure 46:
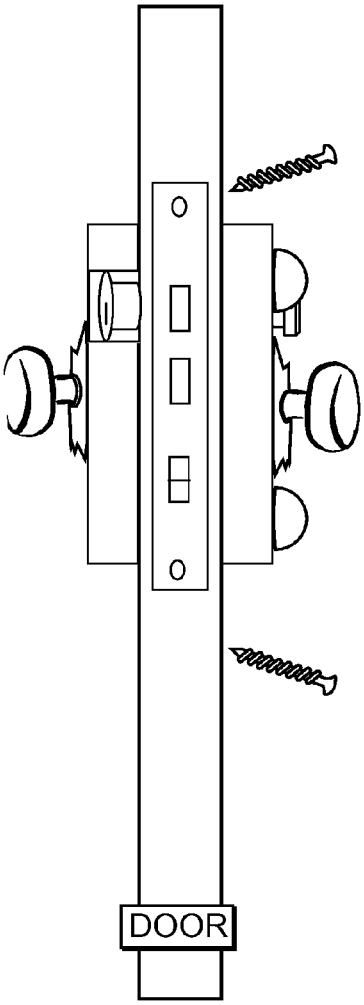
FIG. 46 PRIOR ART
FIG. 46 is a schematic of a mortise locking system in the prior art.
Figure 47:
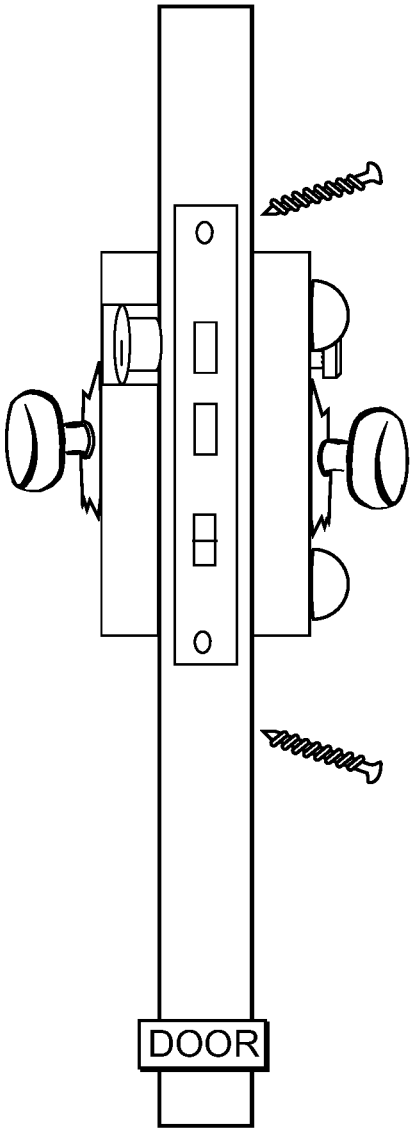
FIG. 47 PRIOR ART
FIG. 47 is a schematic of a mortise locking system in the prior art.

FIG. 41 provides a block diagram illustrating a schematic of a switch motor board 552 connected to the control board 501. The switch motor board 552 connects to the control 501 with cables 556 or any other form of connection, and the control board connects to a radio module 556. The switch motor board 552 has a cam 544 and three cam switches: switch 1 (546), switch 2 (548), and switch 3 (550). The cam 544 rotates in response to signals from the control board 501 and corresponding to the position of the dead bolt 130. The rotation of the cam 544 activates the cam switches, and the motor 525 rotates the worm 504 in accordance with the configuration of the cam switches. The tables provided in FIG. 42 and FIG. 43 lay out the conditions of the locking system 100 that correspond to particular cam switch configurations. For instance, when all three cam switches are disengaged, the locking system 100 is in the locked position. When the cam 544 engages switch 2 and switch 3, the locking system 100 is in the neutral position. Finally, when the cam 544 engages all three cam switches, the locking system 100 is in the open position. If any other combination of cam switch positions occur, the locking system responds with corresponding errors or contingency measures as per the table in FIG. 42. FIG. 48 shows alternative conditions of the locking system 100 corresponding to particular cam switch configurations. FIG. 44 shows a flow chart with cam switch timers and current monitoring.

Figure 37:
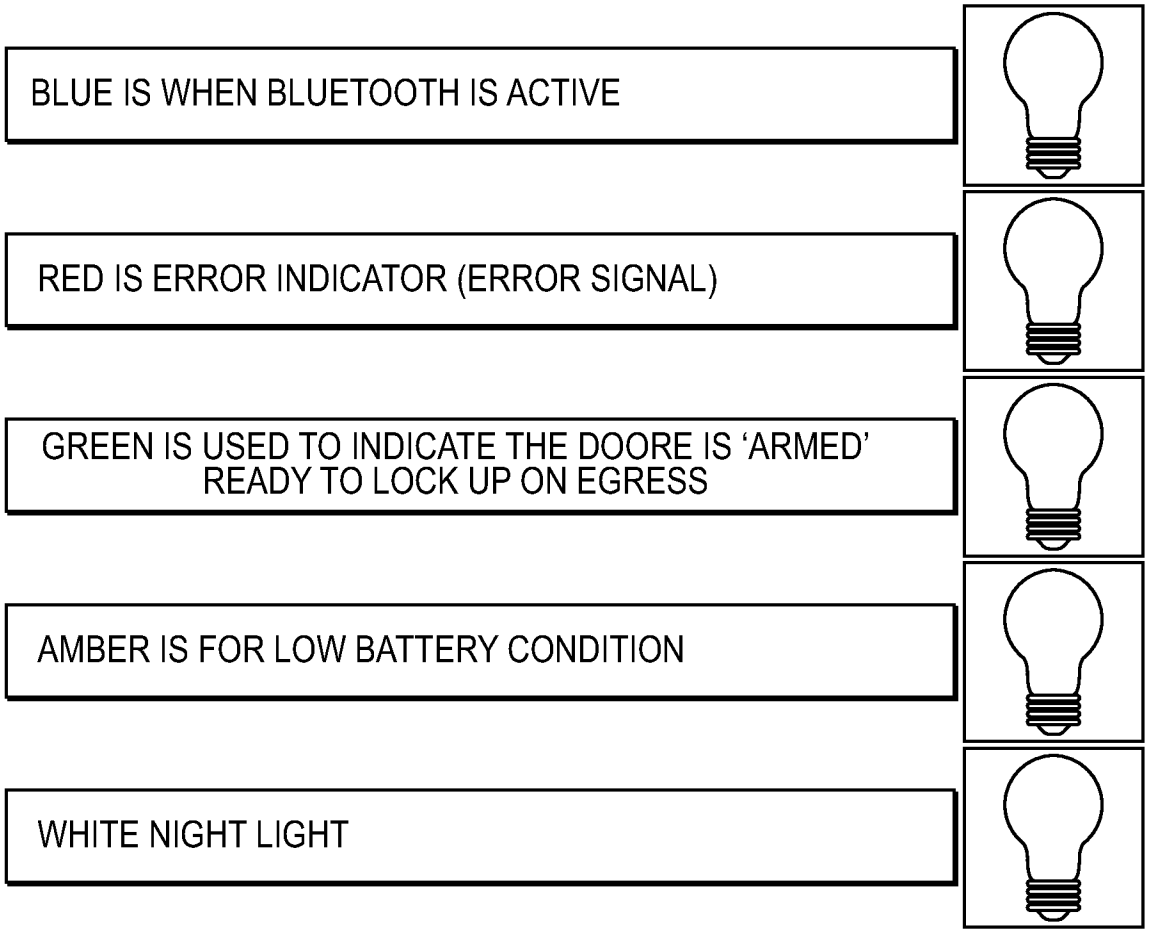
FIG. 37 is a diagram of the function of a light emitting diode in accordance with the disclosure.

A light emitting diode (LED) 511 is mounted behind the lock cylinder 302 and illuminates through LED hole 513. The LED 511 is visible through the lock cylinder's 302 keyway and provides visual indications as to the locking system's 100 status. FIG. 37 is a diagram of LED 513 functions. The LED 513 shows blue when the Bluetooth feature of the locking system 100 is active. A red LED 513 indicates an error, and a green LED indicates that the locking system 100 is "armed." When the locking system 100 is "armed," the system will lock, i.e. move the dead bolt 130 to the locked position, once the door 126 closes. An amber LED 513 indicates a low battery condition and a white LED is a night light to aid the user in finding the keyway in the dark. The LED 513 can operate as a flashing light or a solid light. FIG. 37 shows one possible LED color scheme, though any color combination can be used.

Figure 35:
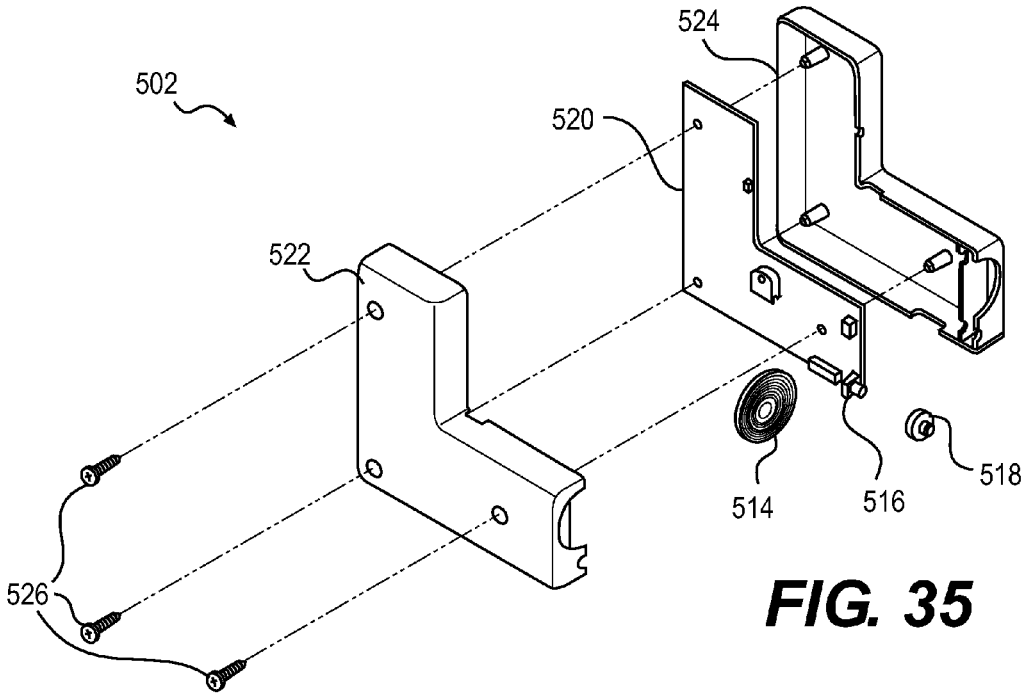
FIG. 35 is an exploded view of the central processing unit in accordance with the disclosure.
Figure 36:
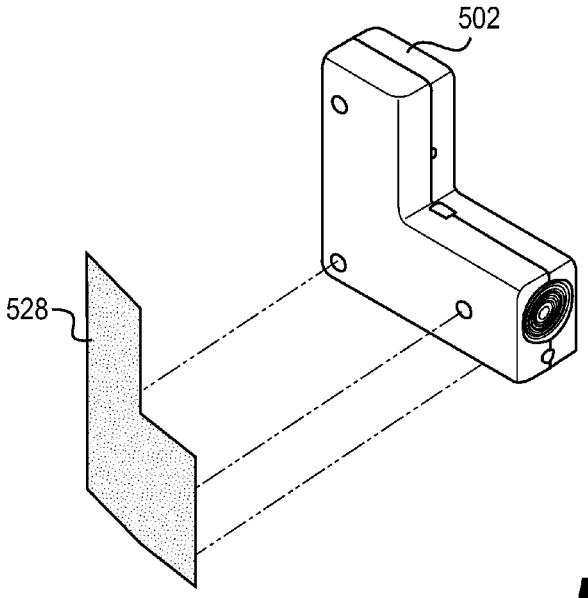
FIG. 36 is a perspective view of the central processing unit of FIG. 35.

The embodiment of the disclosed CPU 502 in FIG. 35 and FIG. 36 has a front case 522, a back case 524, CPU control board 520, speaker 514, an activation switch 516, and an elastomeric boot 518. The CPU control board 520 controls the speaker 514 and the activation switch 516. A user can press the activation switch 516 in order to set the locking system 100 to automatically lock when the user closes the door 126. The elastomeric boot 518 protects the activation switch 516 and other CPU 502 parts from weather or other elements. The CPU 502 is held together by a set of three CPU fasteners 526 that penetrate through the front case 522, the CPU control board 520, and screw into the back case 524. Additionally, in one embodiment, a steel plate 528 attaches to the CPU 502 at the front case 522 that prevents attack on the CPU from the exterior through the door 126 from a drill or other suitable tool.

Figure 38:
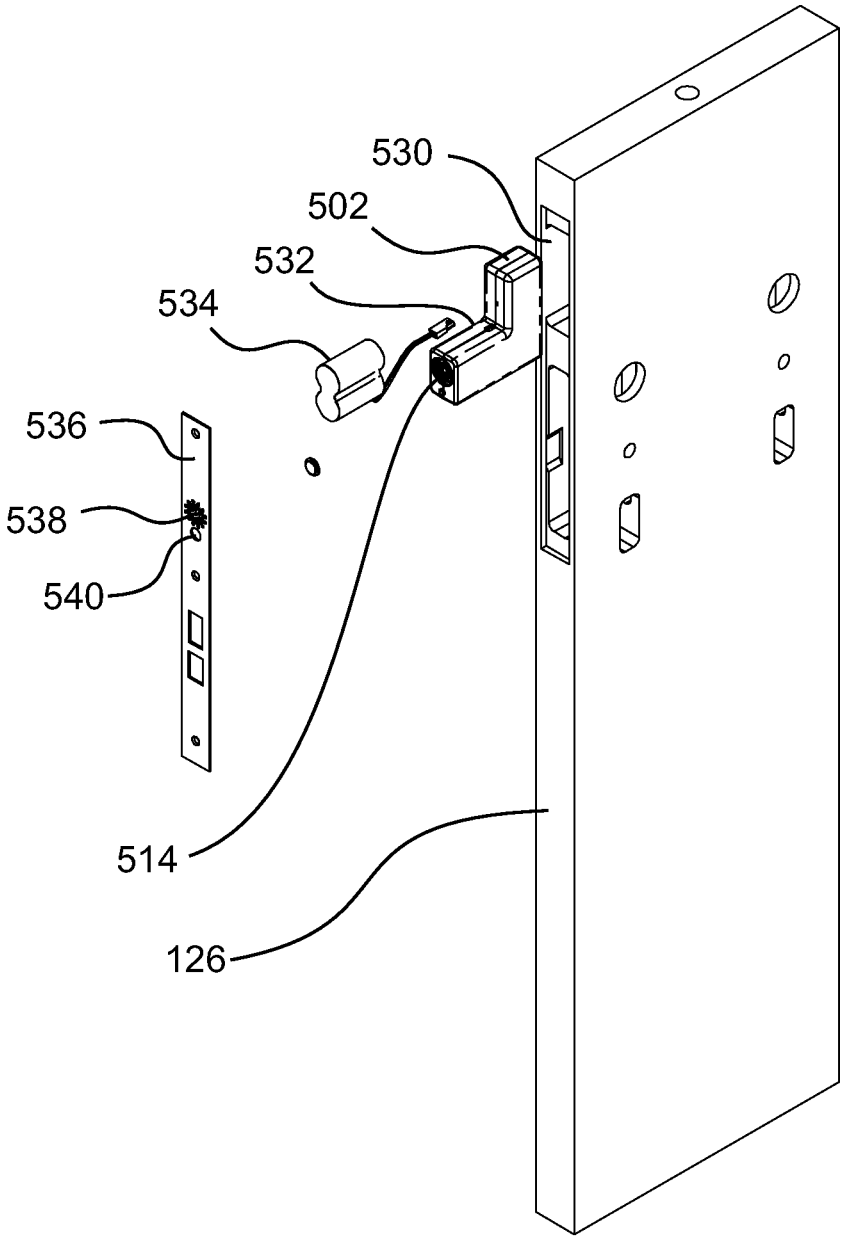
FIG. 38 is a partial exploded view of the door, central processing unit, and armor plate in accordance with the disclosure.
Figure 39:
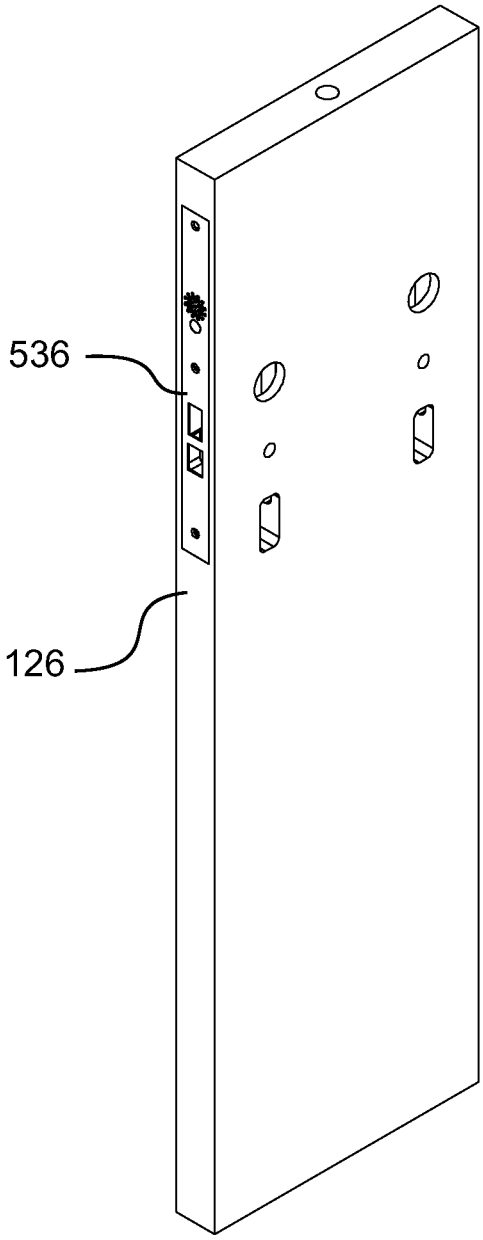
FIG. 39 is a partial exploded view of the door, central processing unit, and armor plate in accordance with the disclosure.
Figures 40A, 40B, 40C, 40D:
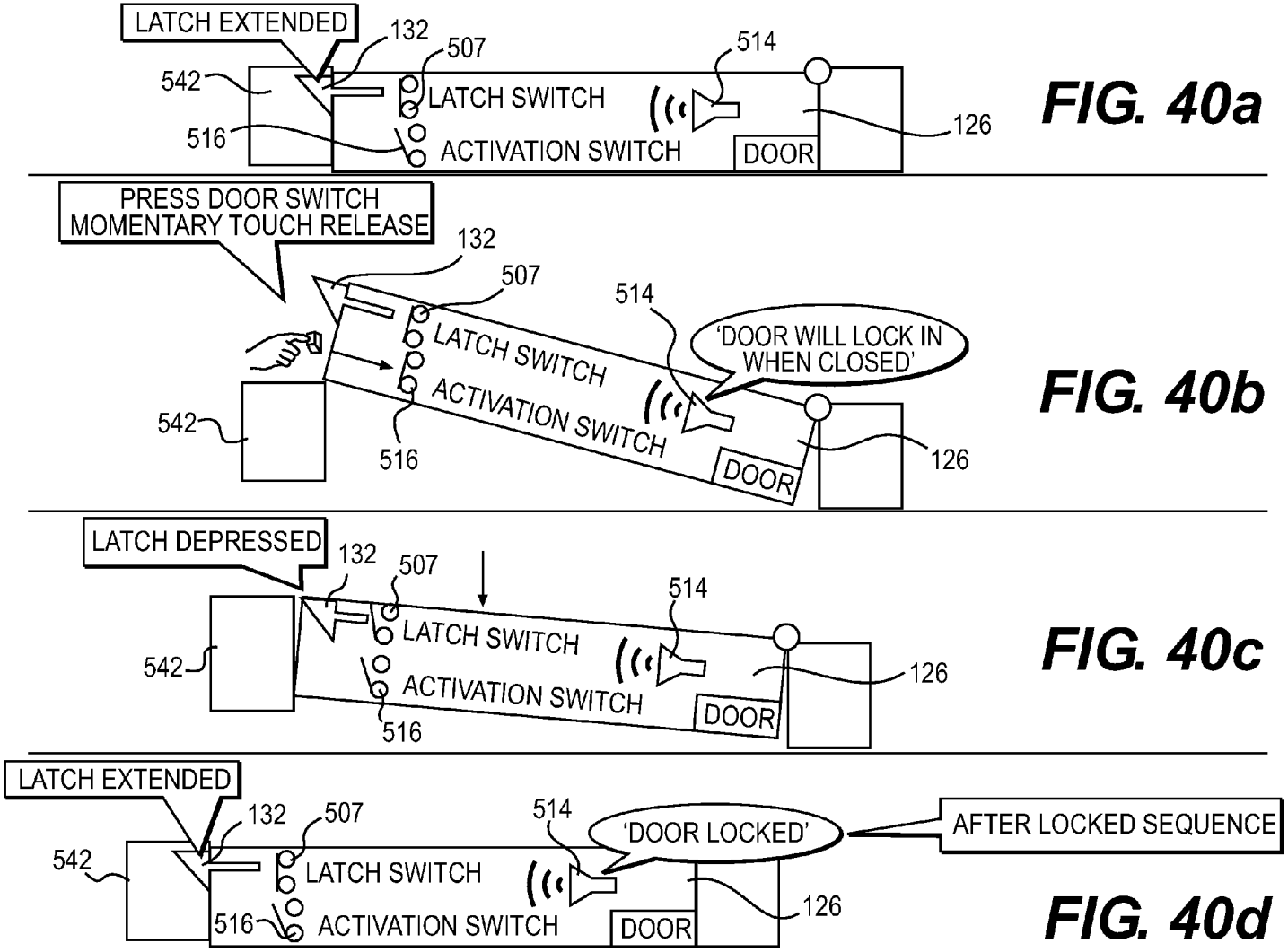
FIGS. 40*a*, 40*b*, 40*c*, and 40*d* are diagrams of the user interface of the auto-locking feature of a locking system in accordance with the disclosure.

FIG. 38 and FIG. 39 show how the CPU 502 mounts into the door 126. The CPU 502 fits into a CPU pocket 530 that is cut into the door above (or below) the mortise pocket 128 for the mortise case 104 and gear box 106. The CPU 502 has a connection 532 that services a battery 534 that powers the CPU. The battery 534 can also provide electric power to the electromechanical drive 500. Alternatively, the CPU 502 could be mounted directly onto the control board 501, or in any other suitable location. Also alternatively, the locking system 100 can be powered using hardwired power lines instead of a battery, or hardwired to a low voltage provider. A wiring harness (not shown) connects the battery 534 to the gear box 106 and the CPU to the control board 501 through an access hole formed in the door, though any suitable connection to provide power or electronic signals can be used. An armor plate 536 fastens to the door 126 covering the CPU 502 and the mortise case 104 embedded in the door. The armor plate 536 has a speaker grate 538, an activation switch hole 540, a bolt slot 428 and a latch slot 430. The speaker grate 538 aligns with the speaker 514 when installed to allow sound from the speaker to escape. The activation switch hole 540 allows the user access to the activation switch 516, and the bolt slot 428 and latch slot 430 allow the dead bolt 130 and latch bolt 132 to pass through the armor plate 536.

FIGS. 40*a*, 40*b*, 40*c*, and 40*d* illustrate the user interface for the locking system's 100 auto-locking functions. The diagrams provide schematic views of the latch switch 507, the activation switch 516, the speaker 514, the door 126 and the door jamb 542. The latch switch 507 is located on or near the latch bolt 132 and is used to detect when the latch bolt has closed mechanically by monitoring the alignment tab 422. In one embodiment, when the latch bolt 132 protrudes from the mortise case 104, the latch switch 507 is in the closed position. When the latch bolt 132 retracts within the mortise case 104, the latch switch 507 is in the open position. No lock functions can be performed if the latch switch 507 is held closed. When the door 126 is open and a user presses the activation switch 540, both the latch switch 507 and the activation switch are in the closed position and, in some embodiments, the speaker provides an audible response (e.g. "Door will lock when closed"). As the door 126 closes and the latch bolt 132 depresses into the mortise case 104, the latch switch 507 and the activation switch 507 move to the open position. When the door 126 closes completely, the latch bolt 132 protrudes out from the mortise case 104 into the door jamb 542 causing the latch switch 507 to move to the closed position and causing the locking system 100 to move to the lock position. The speaker, in some embodiments, then provides another audible response (e.g. "Door Locked").

Installation of the locking system 100 occurs in several steps provided here, though it should be appreciated that an installer can execute the steps in any order deemed appropriate. The installer places the mortise case 104 in the mortise pocket 128, then positions the outer escutcheon 300 on the door 126 adjacent the mortise case 104 such that the thumb lever 434 passes through the door and enters a thumb lever slot 234 in the mortise case and the aligning pin 306 passes through the aligning pin hole 308 in the mortise case. Next, the installer threads the lock cylinder 302 into the outer escutcheon 300 such that it passes through the outer escutcheon and fits into the alignment hole 208 in the mortise case 104. The lock cylinder 302 is then tightened with a set screw that inserts through the face 116 of the mortise case 104, the handle screw 314 is tightened through the door 126 and into the handle 316, and the handle screw cover 315 is installed to cover the handle screw. The installer then places the slotted washer 230 onto the square shaft 224 and inserts the square shaft into the mortise case 104. In embodiments that feature a gear box 106, the installer can align the gear box to the mortise case 104 by threading the disc 202 into the mortise case and placing the gear box against the mortise case such that the alignment pins 206 in the disc engage the alignment holes 210 in the gear box, and the square shaft 224 fits through the threaded area 222. The threaded tube 220 can then be threaded into the gear box 106 at the threaded area 222 such that the square shaft 224 fits inside the threaded tube. The installer can then insert the pin screw 312 through the aligning pin hole 310 to engage the aligning pin 306 and secure the gear box against the mortise case 104. The inner escutcheon 102 can then be installed by fitting the pin 110 through the pin hole 112 and into the alignment hole 208 in the mortise case 104, fitting the lock knob shaft 122 into the shaft hole 124, and fitting the threaded tube 220 through the knob passage 217. The mortise case screw 108 can then be inserted through the face 116 of the mortise case 104 and engage with the cam channel 114 of the pin 110 to pull the inner escutcheon 102 toward the door 126. Finally, the installer can thread the collar 223 to secure the inner escutcheon, position a washer and the knob 218, and secure the knob with a set screw.

Figure 49:
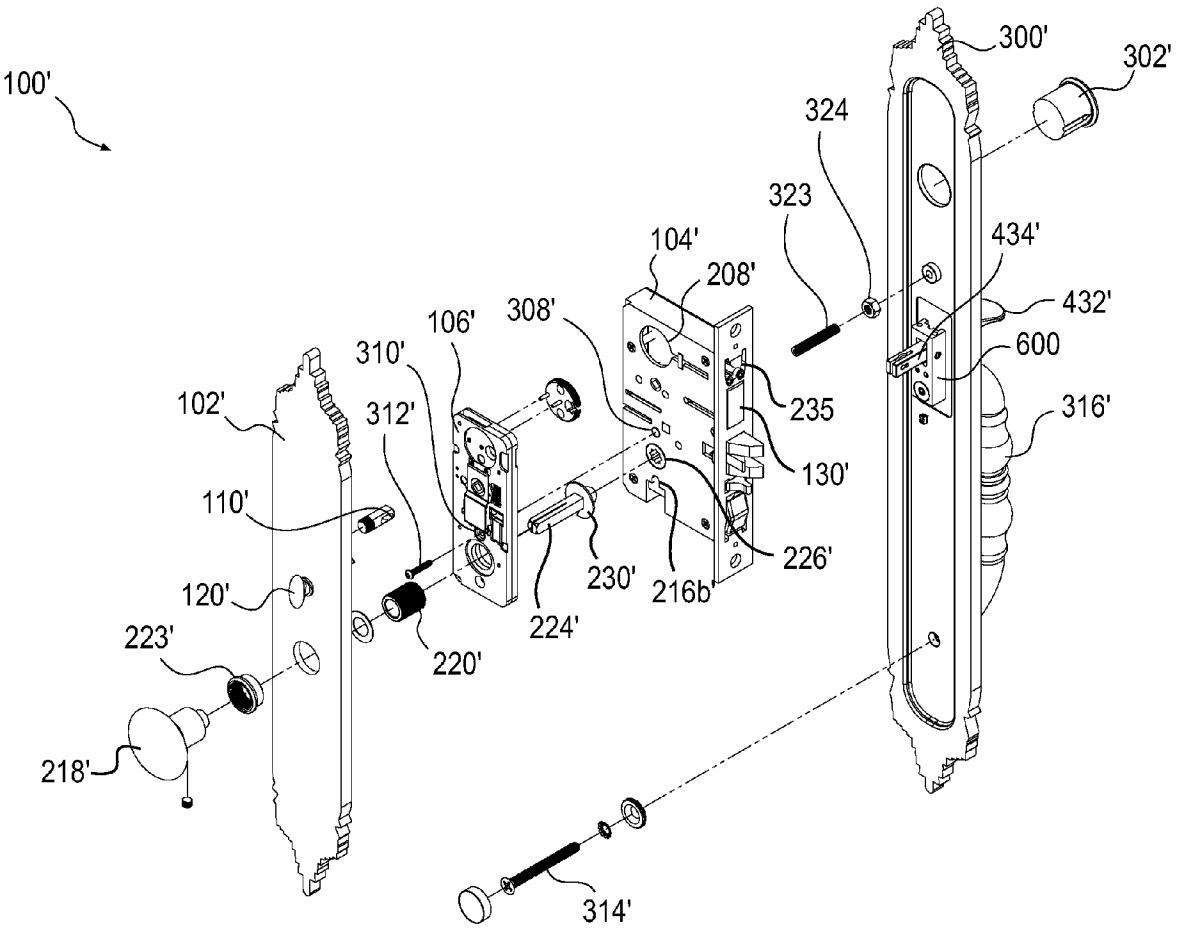
FIG. 49 is an exploded view of another embodiment of the locking system in accordance with the disclosure.
Figure 50:
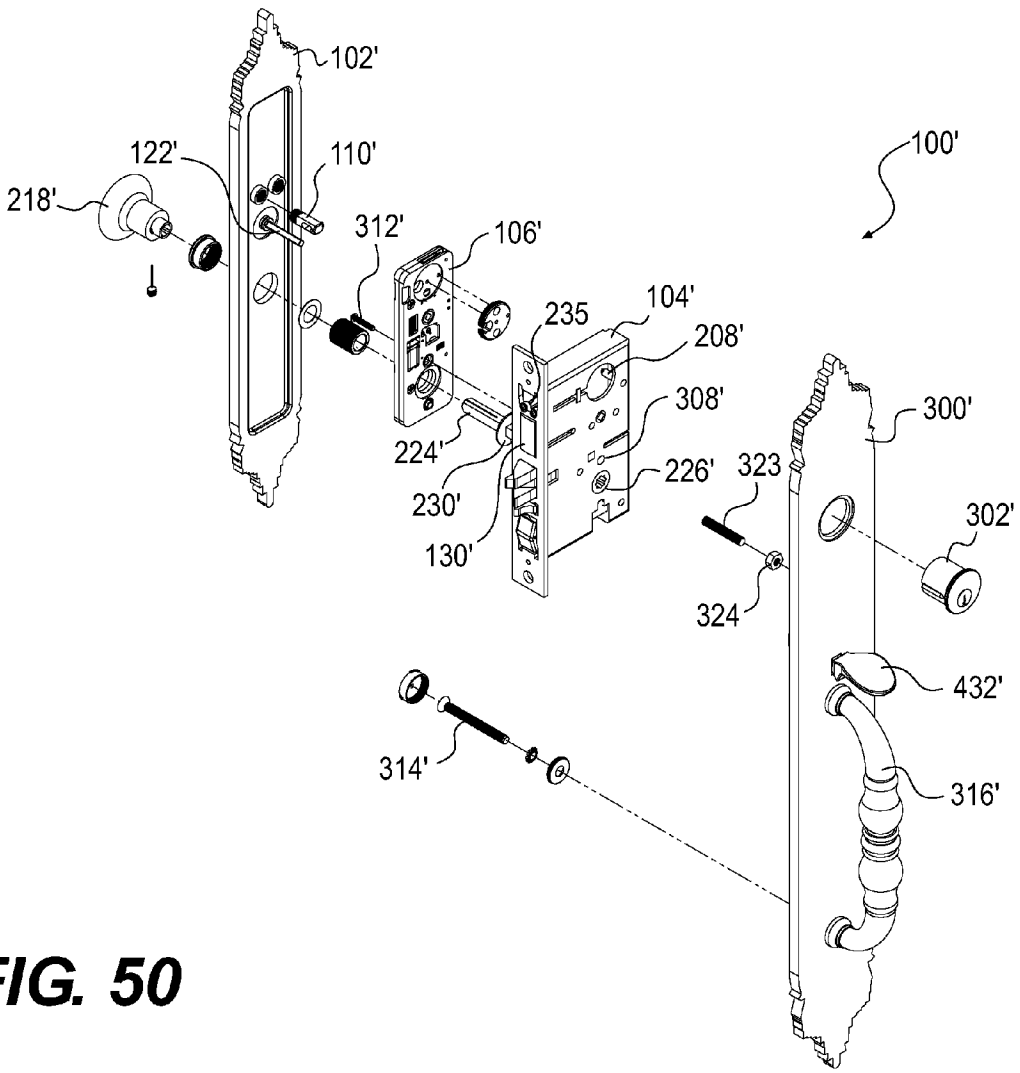
FIG. 50 is an exploded view of the locking system of FIG. 49.
Figure 51:
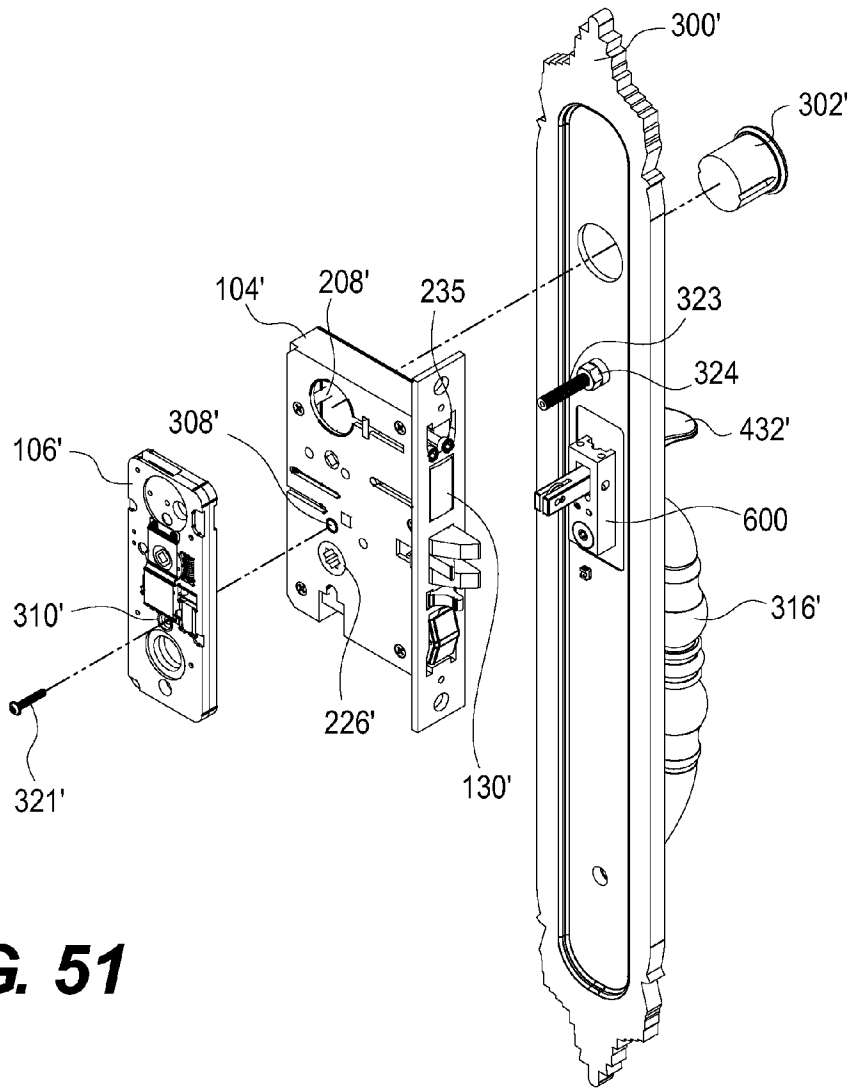
FIG. 51 is an partial exploded view of the locking system of FIG. 49.

FIGS. 49, 50, and 51 illustrate another embodiment of the locking system 100'. The locking system 100' has a mortise case 104', a gear box 106', an inner escutcheon 102', and an outer escutcheon 300'. The inner escutcheon 102' has a knob 218', a lock knob 120', a pin 110', a collar 223', a threaded tube 220', and a lock knob shaft 122'. The outer escutcheon 300' has a handle assembly 316', a thumb piece 432', a handle screw 314', a lock cylinder 302', a threaded shaft 323, and a thumb switch assembly 600. The mortise case 104' has an aligning pin hole 308', a bushing hold 216*b'*, an alignment hole 208', a square shaft 224', a slotted washer 230', a shaft receptacle 226', a dead bolt 130', and a lock cylinder pin 235.

Figure 58:
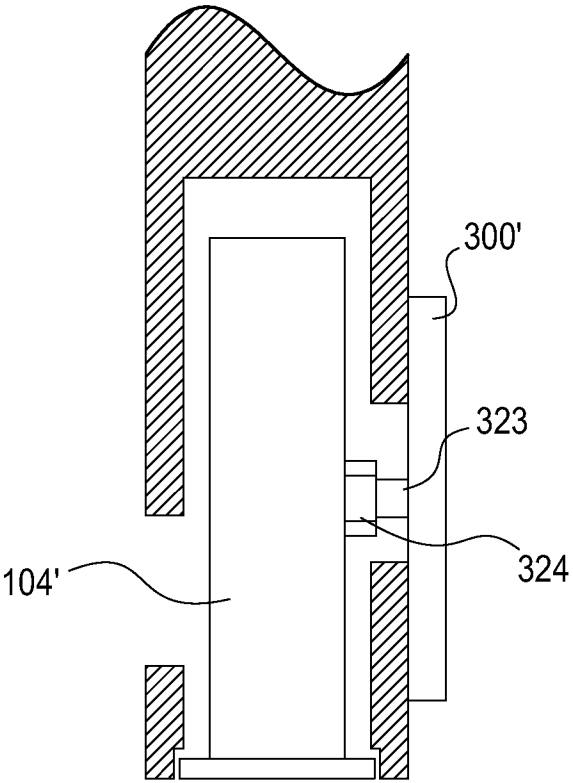
FIG. 58 is a schematic view of the locking system of FIG. 49.

The threaded shaft 323 threads into a spacer nut 324 and into the outer escutcheon 300'. The threaded shaft 323 also fits through the aligning pin hole 308' in the mortise case 104' and through an aligning pin hole 310' in the gear box 106'. A pin screw 312' threads into the interior of the threaded shaft 323, and holds the gear box 106' against the mortise case 104'. As shown in FIG. 58, the spacer nut 324 can be positioned along the length of the threaded shaft 323 to allow proper alignment between the mortise case 104' and the outer escutcheon 300' during installation.

Figure 52:
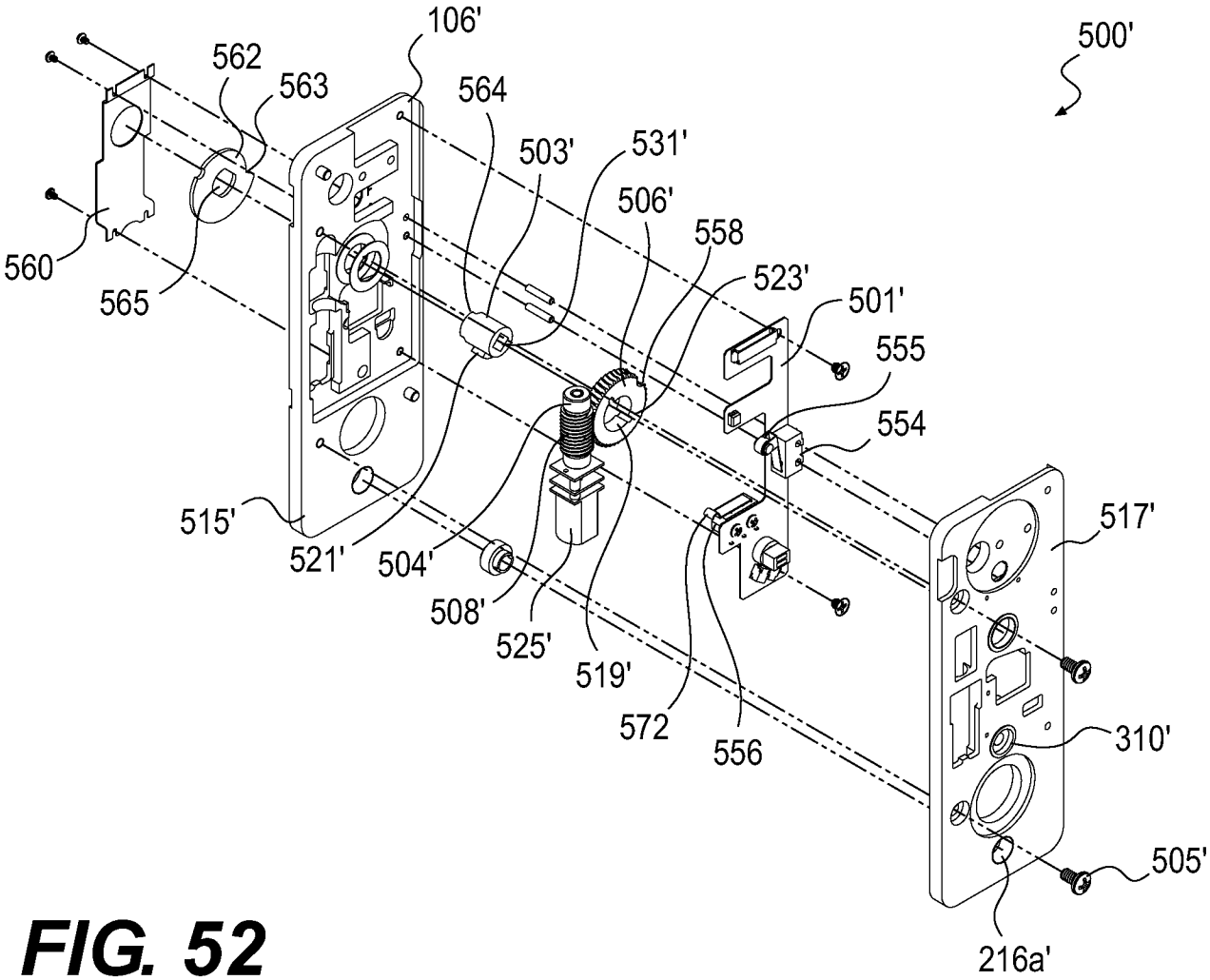
FIG. 52 is an exploded view of a gear box of the locking system of FIG. 49.

FIG. 52 shows an exploded view of an electromechanical drive 500' housed in the gear box 106'. The gear box 106' has a first shell 515' and a second shell 517' held together by gear box fasteners 505', a bushing hole 216*a'*, and an aligning pin hole 310'. The electromechanical drive 500' housed in the gear box 106' has a motor 525' that drives a worm 504' that has spiral teeth 508'. The electromechanical drive 500' also has a worm gear 506' with gear teeth 510' that mate with the teeth 508' of the worm 504'. The worm gear 506' has a notched passage 519' through its interior that defines two notches 523'. A worm gear hub 503' has a hub tab 521', and fits within the notched passage 519'. The worm gear hub 503' can rotate within the notched passage 519' in about 180 degrees of travel. On one extreme of the rotation, the hub tab 521' contacts one notch 523', and on the other extreme of rotation the hub tab contacts the other notch. The lock knob shaft 122' fits within a keyed passage 531' such that rotation of the lock knob shaft causes rotation of the worm gear hub 503', and rotation of the worm gear hub causes rotation of the lock knob shaft. As discussed in further detail above regarding the locking system 100, rotation of the lock knob shaft 122' in locking system 100' similarly results in the dead bolt 130' moving either into the mortise case 104' (the unlocked position) or out of the mortise case (the locked position) due to mechanical connections within the mortise case (see FIG. 15). When the motor 515' rotates the worm 504' in either the clockwise or counterclockwise direction, the geared connection between the worm and the worm gear 506' causes the worm gear to rotate. When the worm gear 506' rotates to a point where one of the notches 523' contacts the hub tab 521', the worm gear hub 503' rotates. Rotation of the worm gear hub 503' causes rotation of the lock knob shaft 122', which results in moving the dead bolt 130' into or out of the mortise case 104'. In this way, the electromechanical drive 500' causes the locking system 100' to go from an unlocked condition to a locked condition, or vice versa.

The electromechanical drive 500' also features a control board 501'. The control board 501' receives electronic signals with instructions from a CPU 502', illustrated in FIG. 54 and discussed in greater detail below. The control board 501' has a neutral detect switch 554 and a position detect switch 556 located on the control board. The neutral detect switch 554 includes a neutral indicator 555 that fits within an indentation 558 on the worm gear 506'. During operation of the electromechanical drive 500', the motor 525' rotates the worm 504' and the worm gear 506' rotates as a result until the dead bolt 130' is in the locked or unlocked position. Once in either position, the motor 525' rotates the worm 504' and worm gear 506' in the opposite direction until the neutral indicator 555 falls into the indentation 558. When the neutral indicator 555 falls into the indentation 558, the neutral detect switch 554 sends and electronic signal to the control board indicating that the locking system 100' is in a neutral position, and the control board sends a signal to the motor 525' to halt rotation. While in the neutral position, the locking system 100' can be either locked or unlocked by manually turning the lock knob 120' to actuate the dead bolt 130'. Alternatively, the electromechanical drive 500' can be put into a position in which the dead bolt 130' cannot be manually actuated using the lock knob 120'. For example, after the motor 525' rotates the worm gear 506' to the position corresponding to a locked position, the motor can rotate the worm gear 180 degrees, passing the position where the neutral indicator 555 falls into the indentation 558. In this position, the hub tab 521' contacts the notch 523' opposite the notch the hub tab contacted that caused the lock knob shaft 122' to rotate into the locked position. While the worm gear 506' is in this position against the hub tab 521', the notch 523 prevents the hub tab from being moved manually to return the lock knob shaft 122' to an unlocked position.

The gear box 106' also includes a bracket 560 connected to the first shell 515' that houses a washer cam 562. The washer cam 562 has a cam edge 563 and a hub passage 565. A keyed end 564 of the worm gear hub 503' fits through a hub hole 568 in the first shell 515' and into the hub passage 565. When the worm gear hub 503' rotates in reaction to the worm gear 506', the washer cam 562 rotates as well. Thus, the washer cam 562 rotates as the dead bolt 130' moves in and out of the mortise case 104', moving the locking system 100' from the locked to unlocked condition, or vice versa. The first shell 515' also defines a switch access hole 570. A position indicator 572 on the position detect switch 556 fits through the switch access hole 570. As the washer cam 562 rotates, the cam edge 563 comes into contact with the position indicator 572 and moves it from a first position to a second position, or vice versa. In one embodiment, the washer cam 562 moves the position indicator 572 to the first position when the dead bolt 130' is in the locked position, and the washer cam moves the position indicator to the second position when the dead bolt is in the unlocked position. When the position indicator 572 is in the first position, the position detect switch 556 sends a signal to the control board 501' indicating that the locking system 100' is in the locked position. When the position indicator 572 is in the second position, the position detect switch 556 sends a signal to the control board 501' indicating that the locking system 100' is in the unlocked position, and the control board sends a corresponding signal to the CPU 502'.

The CPU 502' has wireless signal receiver and is capable of sending and receiving wireless signals from various wireless devices, such as cellular telephones, smart phones, or various other wireless devices using a variety of wireless signals such Bluetooth™ signals, wireless internet, RFID, etc. Through the CPU 502', the locking system 100' is capable of receiving instructions from a wireless device inquiring whether the locking system is in a locked or unlocked position. When the proper signal is received by the CPU 502', the CPU checks the position of the state of the position detect switch 556, which corresponds to the locked/unlocked position of the locking system 100'. The CPU 502' then uses its wireless receiver to transmit a wireless signal to the wireless device indicating whether the locking system 100' is in a locked or unlocked position. Additionally, the CPU 502' can be set to send an alert to a wireless device when the locking system 100' is moved from to or from a locked or unlocked position. A change in the state of the position detect switch 556 would trigger the CPU 502' to-transmit a corresponding signal to the wireless device using the wireless transmitter. Alternatively, the control board 501' can have a wireless receiver and can be programmed to send and receive the above signals instead of the CPU 502'.

Figure 68:
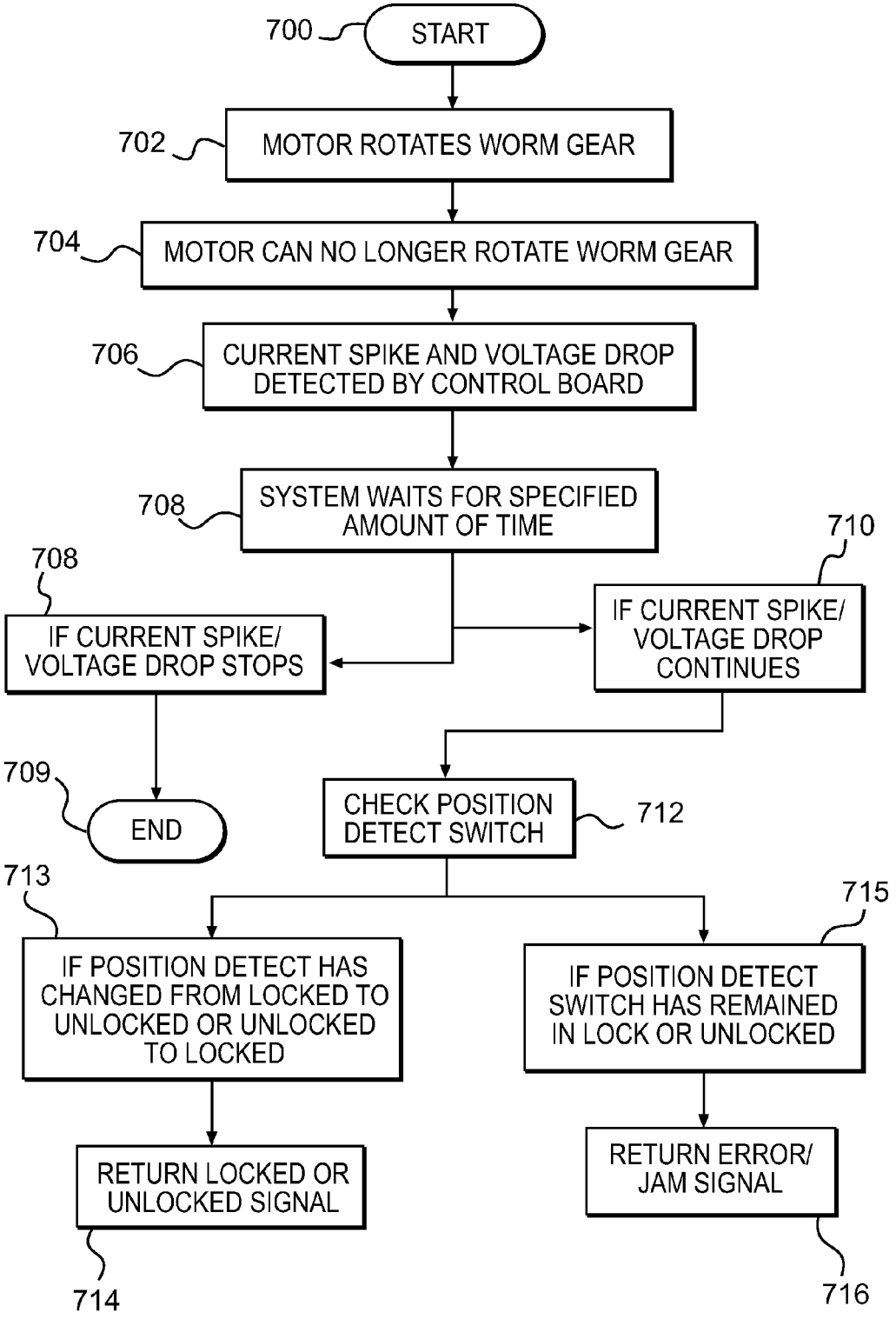
FIG. 68 is a flow chart illustrating a jam checking procedure in accordance with the disclosure.

As illustrated in the flow chart in FIG. 68, the locking system 100' also implements a circuit, for example, an analog-to-digital (ADC) circuit, to determine whether a jam has occurred in the electromechanical drive 500'. When the motor 525' reaches a position where it can no longer rotate the worm gear 506', for example, when the locking system 100' reaches the locked or unlocked position, a spike in current and/or a drop in voltage can be detected in the circuit by the control board 501'. When this current spike is detected in the ADC circuit and is sustained for a specified period of time, for example, three seconds, the control board 501' checks whether the position detect switch 556 has changed to or from a locked or unlocked condition. If the position detect switch 556 has changed conditions, the control board 501' concludes that no jam has occurred and the locking system 100' is properly in either the locked or unlocked condition. If, when the current spike or voltage drop is detected, the position detect switch 556 and position indicator 572 has not changed conditions from lock to unlock or vice versa, the control board 501' concludes that a jam has occurred and sends a corresponding signal to the CPU 502'. In this way, the ADC circuit is used in conjunction with the position indicator 572 on the position detect switch 556 to determine the status of the locking system 100'. The ADC circuit provides logical control over the locking system's 100' condition and, specifically, the lock knob shaft 122' position that indicates the dead bolt 130' position, based upon and along with the position indicator 572 position and position detect switch 556.

Figure 53:
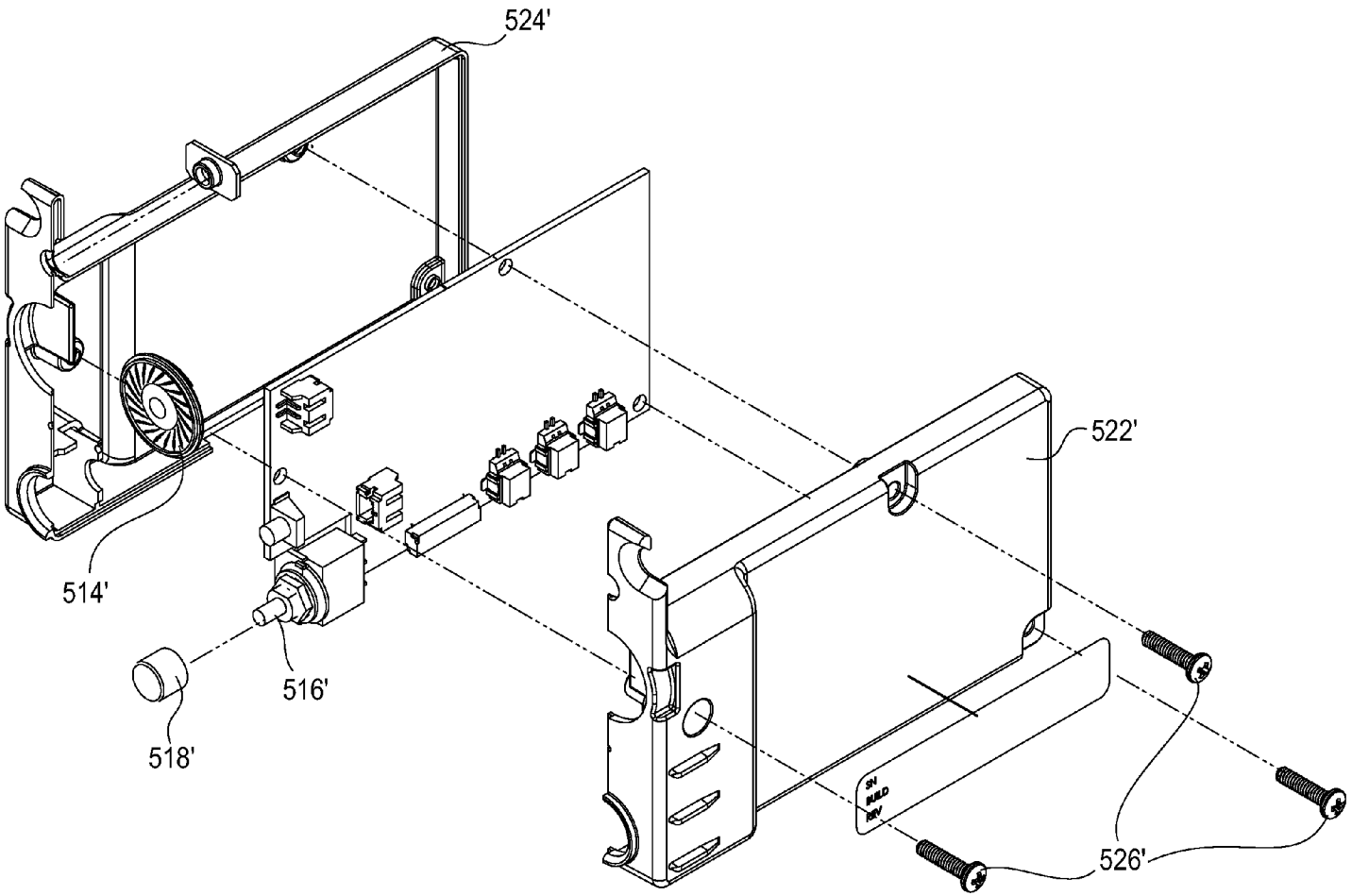
FIG. 53 is an exploded view of a CPU of the locking system of FIG. 49.

FIG. 53 illustrates the CPU 502'. The CPU 502' has a front case 522' and a back case 524' held together by fasteners 526'. The CPU 502' also has a speaker 514', a boot 518', an activation switch 516', and a CPU control board 520'. The CPU 502' is connected to the control board 501' with wires or other suitable electronic connection. The CPU 502' is capable of activating auto-locking functions similar to those discussed above regarding CPU 502 and illustrated in FIGS.

40*a*, 40*b*, 40*c*, and 40*d*. CPU 502' and the control board 501' are powered by batteries or a hard wired electronic connection.

Figure 54:
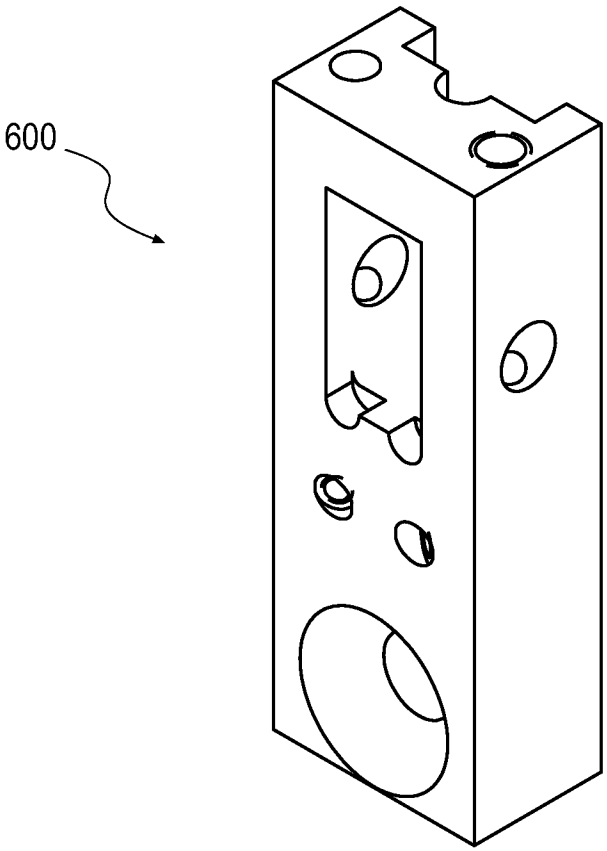
FIG. 54 is a perspective view of a thumb switch assembly of the locking system of FIG. 49.
Figure 55:
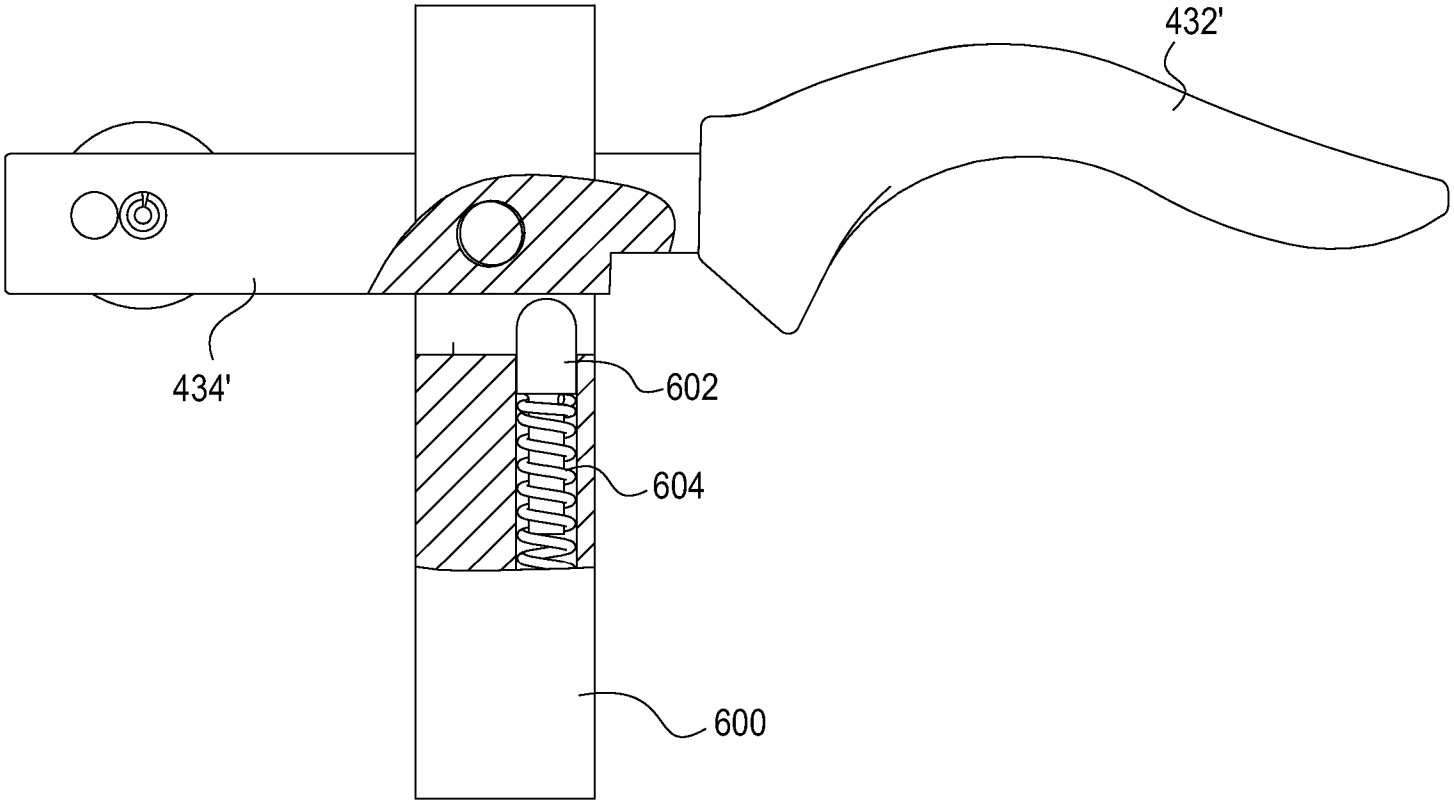
FIG. 55 is a partial sectional view of the thumb switch assembly of FIG. 54.
Figure 57:
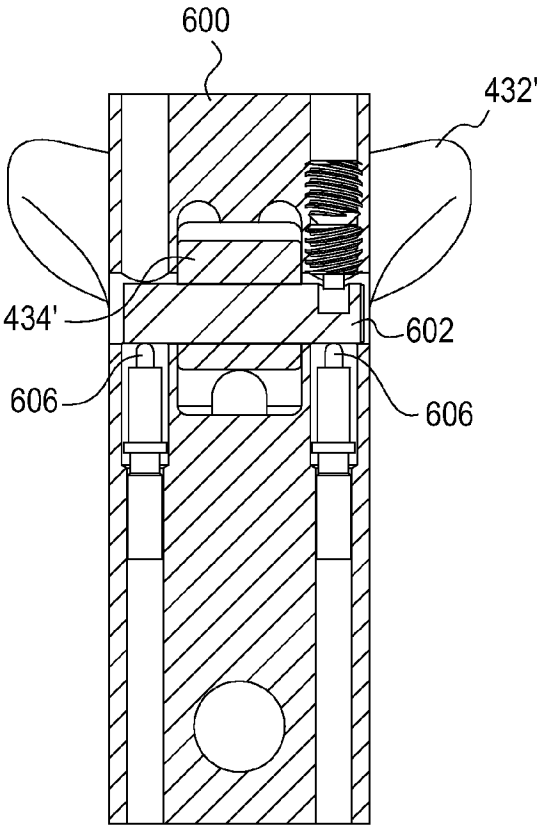
FIG. 57 is a partial sectional view of the thumb switch assembly of FIG. 54.
Figure 56:
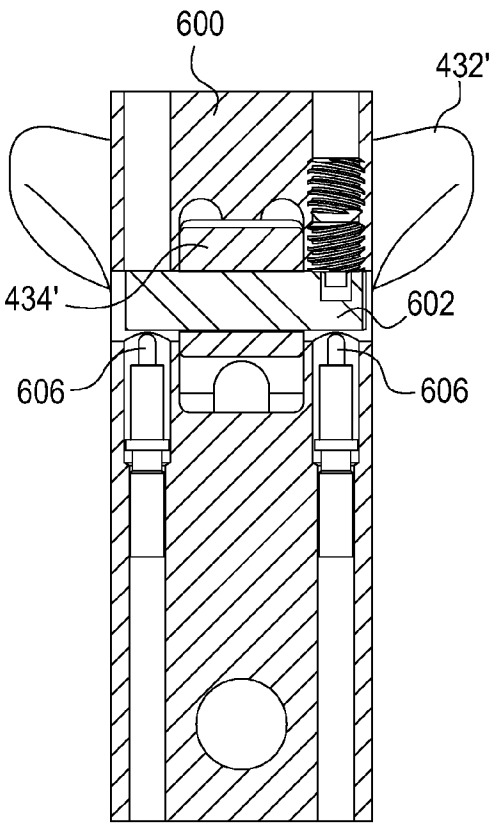
FIG. 56 is a partial sectional view of the thumb switch assembly of FIG. 54.

FIG. 54 illustrates the thumb switch assembly 600. The thumb switch assembly 600 is mounted on the outer escutcheon 300' around the thumb lever 434', as can be seen in FIG. 49. FIG. 55 illustrates a cross-section of the thumb switch assembly 600 in conjunction with the thumb piece 432' and the thumb lever 434'. The thumb switch assembly 600 includes a trigger pin 602 and a trigger spring 604. The trigger spring 604 contacts the trigger pin 602 and biases it upwards against the thumb lever 434'. FIGS. 56 and 57 illustrate another view of the thumb switch assembly 600 with the thumb piece 432' and the thumb lever 434', additionally illustrating contacts 606. The trigger pin 602 and the contacts 606 are all made of a suitably conductive material, such as a metallic alloy, that allows electric flow through each part. When the thumb piece 432' is depressed with sufficient force, it causes the thumb lever 434' to move the trigger pin 602 downward until the trigger pin touches the contacts 606 simultaneously. When the thumb piece 432' is released, the trigger spring 604 pushes the trigger pin 602 upward so it no longer touches the contacts 606. FIG. 56 illustrates the position when the trigger pin 602 is not touching the contacts 606, and FIG. 57 illustrates the position when the trigger pin 602 is touching the contacts. Alternatively, the thumb lever 434' can cause the trigger pin 602 to move downward as a result of turning the knob 218', which causes the trigger pin to touch the contacts simultaneously.

In normal conditions, the locking system 100' is in a standby or "pulse" mode, wherein the CPU 502' make periodic checks through its wireless receiver searching for wireless devices and any incoming wireless signals. Operating in the standby or pulse mode requires power to be supplied from a power source, such as a battery 534', which may have a limited life. In order to conserve battery life or for any other reason, the locking system 100' has sleep circuitry that enables the system to be put into a "sleep" or "vacation" mode wherein it uses no power and, thus, does not drain the power supply. One way to activate sleep or vacation mode is to use a wireless device in communication with the CPU 502' to instruct the locking system 100' to enter sleep or vacation mode, and the locking system will stop drawing power from the power source. In order to wake the locking system from sleep or vacation mode, the thumb piece 432' is depressed, causing the thumb lever 434' to push the trigger pin 602 downward until it touches the contacts 606 simultaneously. Alternatively, the knob 218' can be turned to cause the thumb lever 434' to push the trigger pin 602 downward. The contacts 606 are connected to the control board 501' or CPU 502' by wires or other conductive material. When the trigger pin 602 touches the contacts 606 simultaneously, a circuit is completed in the thumb switch assembly 600, which signals the locking system 100' to leave vacation mode and return to standby or pulse mode. At this time, all electronic functions of the locking system 100' are restored.

Figure 59:
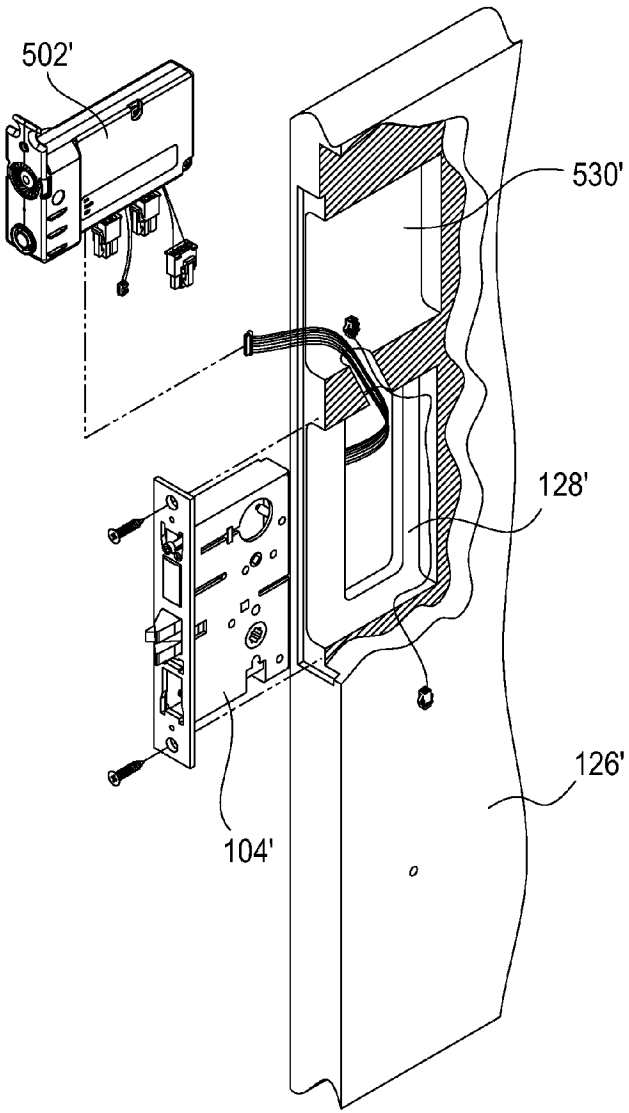
FIG. 59 is a partial exploded view of the locking system of FIG. 49.
Figure 60:
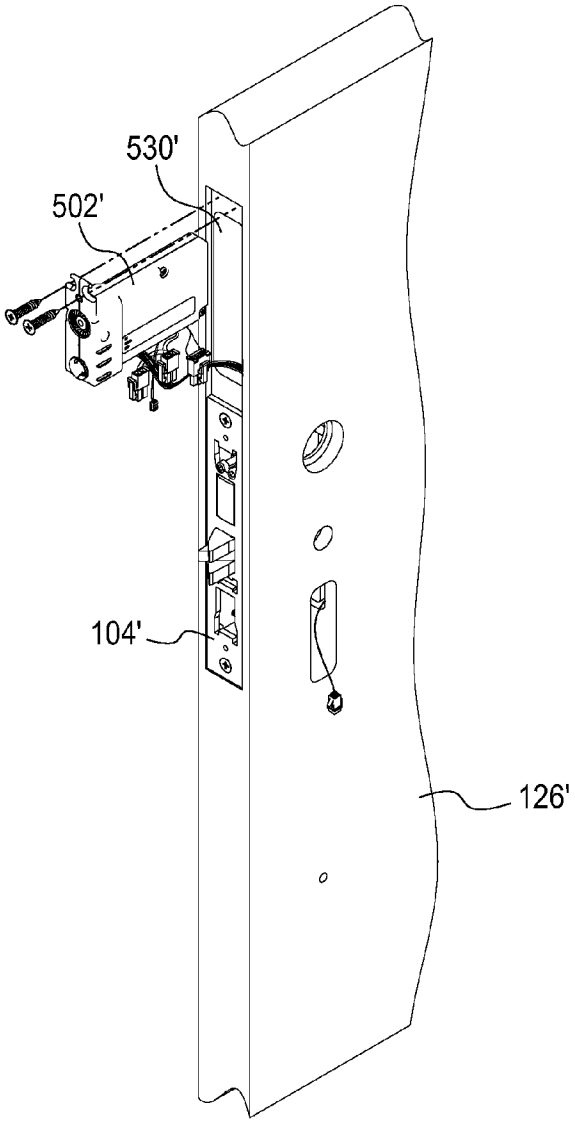
FIG. 60 is a partial exploded view of the locking system of FIG. 49.
Figure 61:
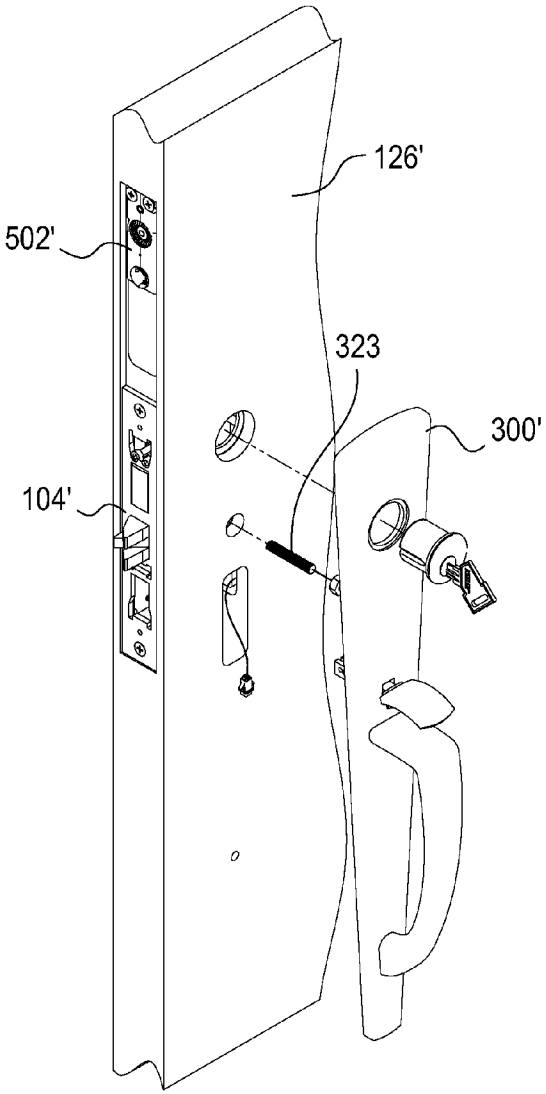
FIG. 61 is a partial exploded view of the locking system of FIG. 49.
Figure 62:
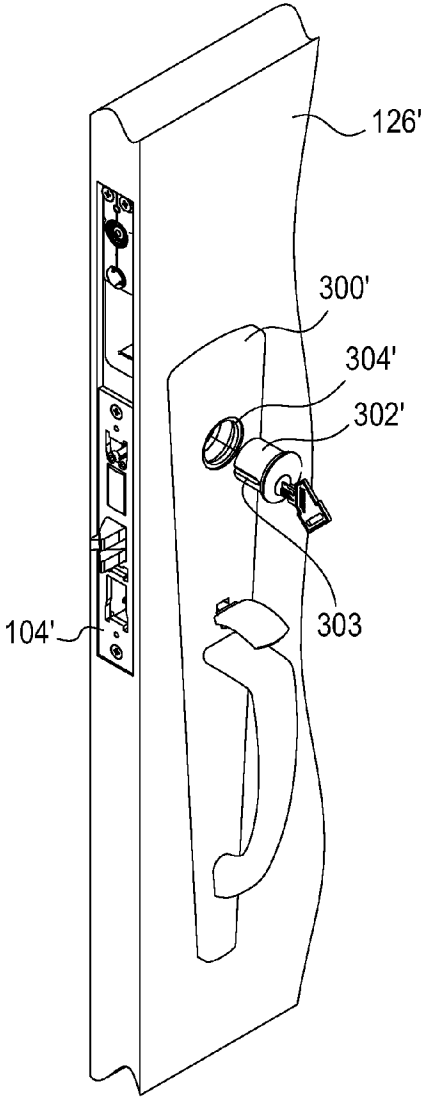
FIG. 62 is a partial exploded view of the locking system of FIG. 49.
Figure 63:
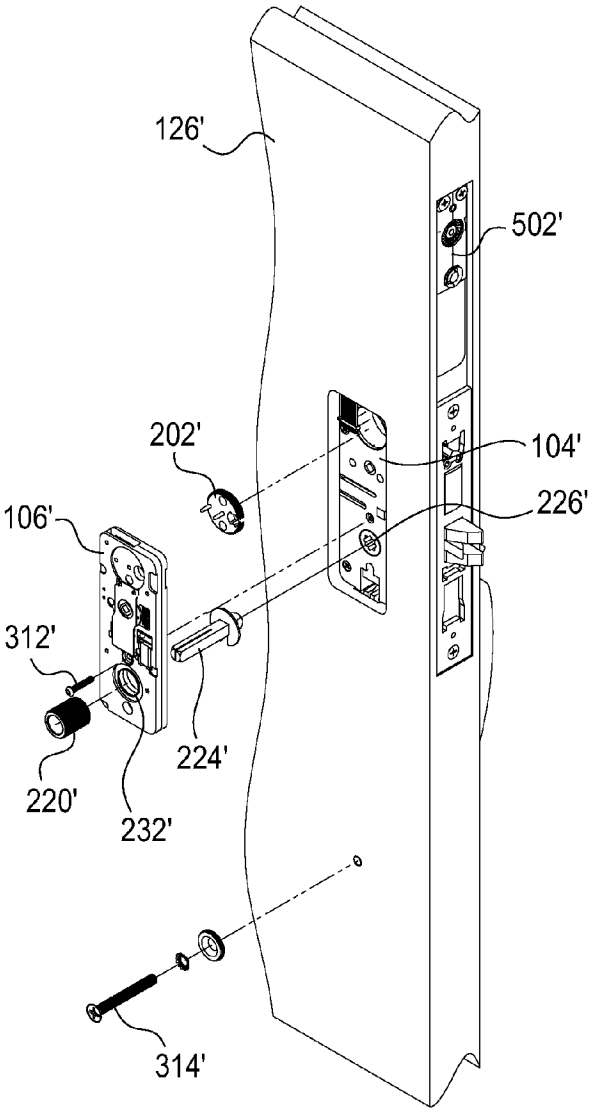
FIG. 63 is a partial exploded view of the locking system of FIG. 49.
Figure 64:
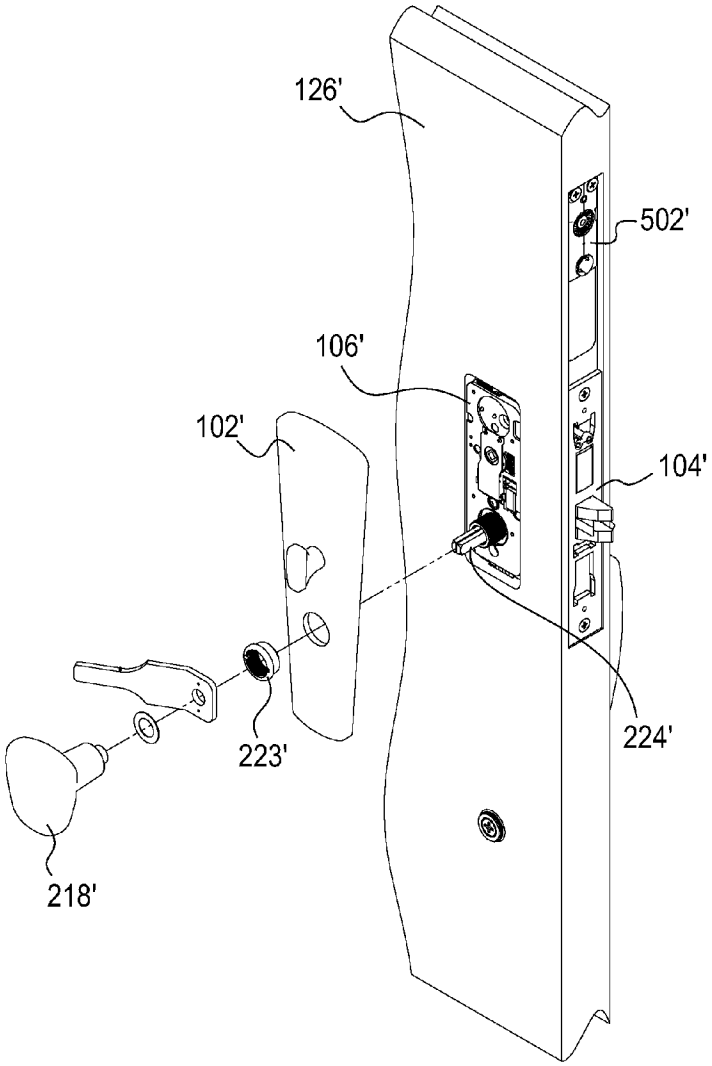
FIG. 64 is a partial exploded view of the locking system of FIG. 49.
Figure 65:
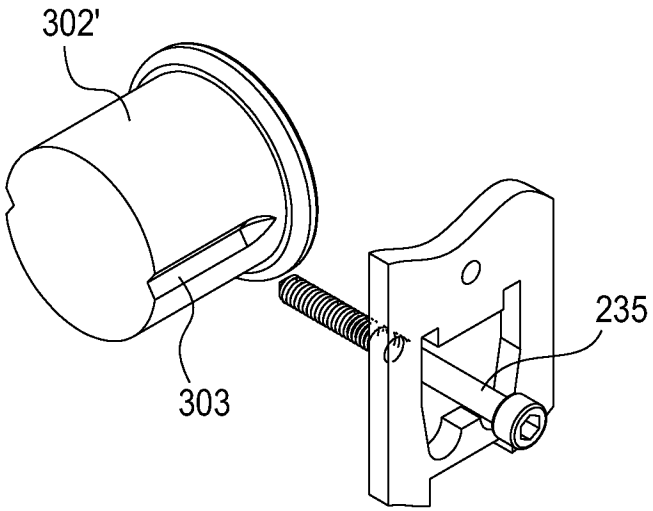
FIG. 65 is a perspective view of a locking cylinder of the locking system of FIG. 29.
Figure 66:
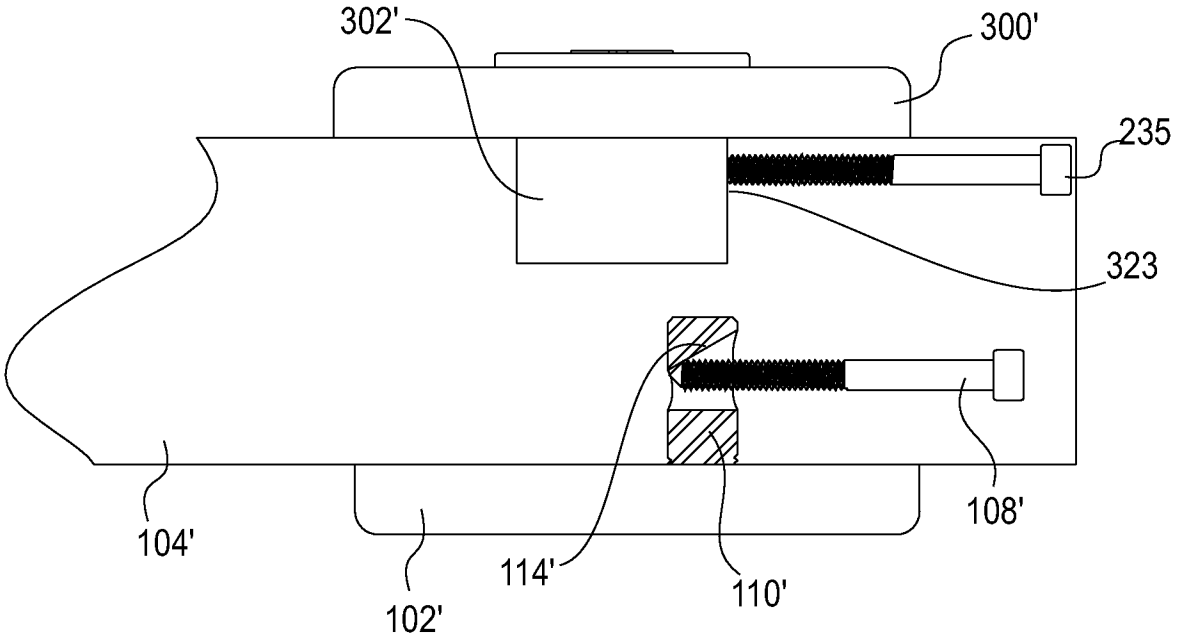
FIG. 66 is a partial sectional view of the locking system of FIG. 49.
Figure 67:
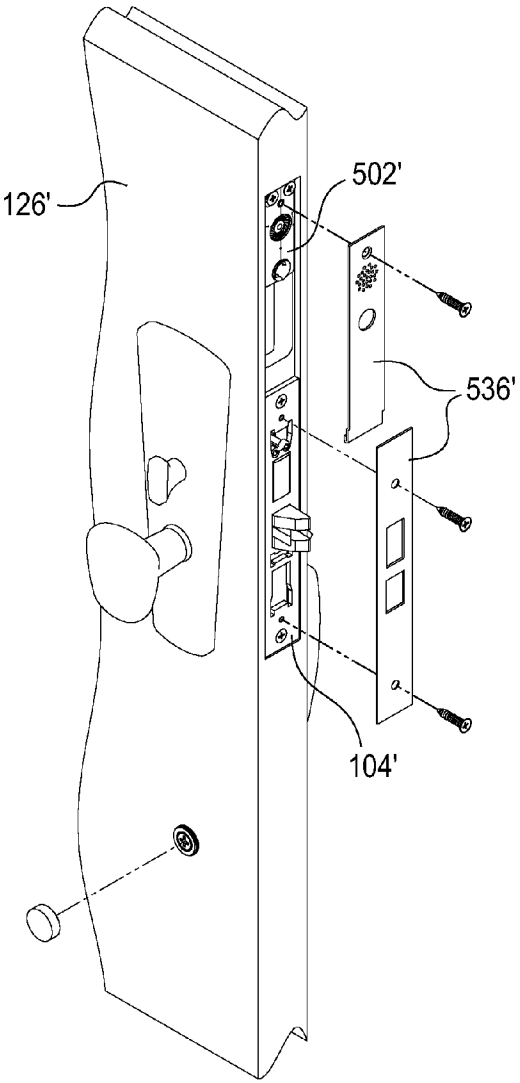
FIG. 67 is a partial exploded view of the locking system of FIG. 49.

FIGS. 59 through 67 illustrate one method of installing the locking system 100' into a door 126'. It will be appreciated that the steps indicated herein are in no particular order and can be executed in different ways to achieve the same result. As illustrated in FIGS. 59 and 60, the mortise case 104' is installed into a mortise pocket 128', and the CPU 502' is installed into a CPU pocket 530', along with the proper wiring to link the CPU to other electromechanical drive 500' and other parts of the locking system 100'. Fasteners can be used to secure the mortise case 104' and the CPU 502'. As illustrated in FIG. 61, the outer escutcheon 300' is installed against the door 126' adjacent the mortise case 104' using the threaded shaft 323 to properly align the outer escutcheon with the mortise case. As illustrated in FIG. 62, the lock cylinder 302' is inserted through the lock hole 304' and into the mortise case 104'. As best illustrated in FIGS. 65 and 66, the lock cylinder 302' has an angled groove 303 cut into a side surface. As the lock cylinder pin 235 is threaded into the mortise case 104', the lock cylinder pin 235 enters the angled groove 323 and holds the lock cylinder 302' in place. Additionally, as the mortise case screw 108' is threaded into the mortise case 104', it engages with the angled cam channel 114' in the pin 110' and pulls the inner escutcheon 102' toward the mortise case. As illustrated in FIG. 63, the gear box 106' is installed in the door 126' against the mortise case 104' using a disc 202' to help align the gear box with the mortise case. The square shaft 224' is installed into the shaft receptacle 226', the threaded tube 220' threaded into the recessed area 232', and the pin screw 312' secured into the threaded shaft 323. As illustrated in FIG. 64, the inner escutcheon 102' is installed onto the door 126' adjacent the mortise case 104' and gear box 106' by aligning the knob 218' and collar 223' with the square shaft 224'. As illustrated in FIG. 67, armor plates 536' to cover the mortise case 104' and the CPU 502'.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A locking system for a door including a mortise pocket and a centerline, the locking system comprising:

a mortise case adapted for disposal within the mortise pocket, the mortise case defining an alignment hole;

an inner escutcheon adapted for disposal on one side of the door adjacent the mortise pocket;

an outer escutcheon adapted for disposal on another side of the door adjacent the mortise pocket;

a pin adapted for fastening substantially perpendicularly to one side of the inner escutcheon and including an angled cam channel, wherein the pin is shaped to enter the mortise case through the alignment hole such that the angled cam channel is disposed inside the mortise case; and a mortise case screw adapted for disposal within the mortise case substantially perpendicular to the pin, wherein one end of the mortise case screw is adapted to engage the angled cam channel and pull the inner escutcheon toward the centerline of the door, without pulling the outer escutcheon towards the centerline of the door, as the mortise case screw is tightened.

2. The locking system of claim 1 further comprising:

a lock knob shaft disposed partially within the mortise case;

a pawl disposed within the mortise case, the pawl having a keyway that receives the lock knob shaft, wherein the pawl is rotatable about the keyway when the lock knob shaft rotates;

a locking bolt disposed within the mortise case, the locking bolt having a proximate end and a distal end, wherein the pawl engages the proximate end;

a dead bolt attached to the distal end of the locking bolt; and wherein the rotation of the pawl actuates the locking bolt within the mortise case, moving the deadbolt from a position inside the mortise case to a position at least partially outside the mortise case.

3. The locking system of claim 2 further comprising a gear box, the gear box comprising:

a worm gear disposed within the gear box, the worm gear defining a notched passage that receives the lock knob shaft;

a worm disposed within the gear box and coupled to a motor capable of rotating the worm, the worm engaging the worm gear such that the worm gear rotates when the worm rotates; and a control board disposed within the gear box, the control board adapted to receive electronic signals and transmit electronic signals to the motor to cause the motor to rotate the worm.

4. The locking system of claim 3 further comprising a worm gear hub defining a keyed passage and a hub tab, the worm gear hub disposed in the notched passage of the worm gear;

wherein the keyed passage receives the lock knob shaft;

wherein the worm gear has at least one notch defining the notched passage and the hub tab is adapted to contact the at least one notch when the gear hub rotates within the notched passage.

5. The locking system of claim 1 further comprising:

a gear box having at least one depression;

at least one disc; and wherein the disc is adapted to fit partially into the alignment hole of the mortise case and simultaneously fit partially into the depression to ensure proper alignment between the mortise case and the gear box.

6. The locking system of claim 1 further comprising:

a gear box defining a bushing hole;

a bushing;

wherein the mortise case further comprises a bushing hole; and wherein the bushing is adapted to fit partially within the bushing hole of the gear box and simultaneously fit partially within the bushing hole of the mortise case to ensure proper alignment between the mortise case and the gear box.

7. The locking system of claim 1 further comprising:

a gear box including a threaded area;

a threaded tube;

wherein the inner escutcheon defines a knob passage; and wherein the threaded tube is adapted to fit partially into the threaded area of the gear box and simultaneously fit partially into the knob passage in the inner escutcheon to ensure proper alignment between the inner escutcheon and the gear box.

8. The locking system of claim 7, further comprising:

a shaft that fits into a shaft receptacle in the mortise case;

wherein the gear box further comprises a shaft hole adjacent the threaded area; and wherein the shaft fits through the shaft hole and into the threaded tube attached to the gear box.

9. The locking system of claim 1, further comprising:

the outer escutcheon defining a lock hole;

a lock cylinder; and wherein the lock cylinder is adapted to pass through the lock hole and simultaneously fit into the alignment hole, ensuring proper alignment between the outer escutcheon and the mortise case.

10. A method of installing a locking system, the method comprising:

providing a door having a mortise pocket and a centerline;

positioning a mortise case within the mortise pocket;

placing an inner escutcheon on one side of the door adjacent the mortise pocket;

placing an outer escutcheon on another side of the door adjacent the mortise pocket;

fastening a pin perpendicular to one side of the inner escutcheon, the pin having an angled cam channel;

positioning the pin within the mortise case such that the angled cam channel is disposed inside the mortise case;

installing a mortise case screw within the mortise case such that one end of the mortise case screw engages the angled cam channel and is substantially perpendicular to the pin; and screwing the mortise case screw into the mortise case to pull the inner escutcheon toward the centerline of the door, without pulling the outer escutcheon towards the centerline of the door.

11. The method of claim 10 further comprising:

installing a gear box within the mortise pocket adjacent the mortise case, the gear box having at least one depression;

providing a disc; and wherein the disc is adapted to fit partially into the alignment hole of the mortise case and simultaneously fit partially into the depression to ensure proper alignment between the mortise case and the gear box.

* * * * *